US009796185B2

(12) United States Patent
Iwaya

(10) Patent No.: US 9,796,185 B2
(45) Date of Patent: Oct. 24, 2017

(54) RECORDING APPARATUS WITH HOUSING AND ATTACHED CASE

(71) Applicant: SEIKO EPSON CORPORATION, Tokyo (JP)

(72) Inventor: Satoshi Iwaya, Ina (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/125,319

(22) PCT Filed: Mar. 9, 2015

(86) PCT No.: PCT/JP2015/001279
§ 371 (c)(1),
(2) Date: Sep. 12, 2016

(87) PCT Pub. No.: WO2015/136915
PCT Pub. Date: Sep. 17, 2015

(65) Prior Publication Data

US 2017/0100939 A1 Apr. 13, 2017

(30) Foreign Application Priority Data

Mar. 14, 2014 (JP) ..... 2014-052604

(51) Int. Cl.

| | |
|---|---|
| ***B41J 2/175*** | (2006.01) |
| ***B41J 29/04*** | (2006.01) |
| ***B41J 29/02*** | (2006.01) |
| *B41J 29/13* | (2006.01) |

(52) U.S. Cl.
CPC ..... *B41J 2/1752* (2013.01); *B41J 2/17509* (2013.01); *B41J 29/02* (2013.01); *B41J 29/04* (2013.01); *B41J 29/13* (2013.01)

(58) Field of Classification Search
CPC ..... B41J 2/1752; B41J 29/04; B41J 2/17509; B41J 29/02; B41J 29/13
See application file for complete search history.

(56) References Cited

U.S. PATENT DOCUMENTS

2014/0043408 A1 2/2014 Kudo et al.
2015/0165772 A1* 6/2015 Aoki ..... B41J 2/17509 347/86

FOREIGN PATENT DOCUMENTS

| | | |
|---|---|---|
| JP | 2003-343522 | 12/2003 |
| JP | 2009-202346 | 9/2009 |
| JP | 2014-037058 | 2/2014 |

* cited by examiner

*Primary Examiner* — Henok Legesse
(74) *Attorney, Agent, or Firm* — Workman Nydegger

(57) ABSTRACT

There is provided a recording apparatus in which a case, in which a liquid container is accommodated, is reliably fixed to a housing with sufficient strength.
A printer includes: a liquid ejecting head that ejects ink and performs recording on a sheet; a housing in which the liquid ejecting head is accommodated; a liquid container in which ink is contained; and a case 141 in which the liquid container is accommodated. In the printer, a metal member is attached to at least one of a wall surface of the housing, which is made of a resin or a wall surface of the case, which is made of a resin, and the metal member reinforces the strength of an attachment portion of the housing with the case.

6 Claims, 24 Drawing Sheets

RECORDING APPARATUS WITH HOUSING AND ATTACHED CASE

TECHNICAL FIELD

The present invention relates to a recording apparatus in which a liquid is ejected from a recording portion and recording is performed.

BACKGROUND ART

In the related art, as a type of recording apparatus, there has been known an ink jet type printer in which ink (liquid) is ejected from a liquid ejecting head (recording portion) to a recording medium such as a sheet, and thereby printing (recording) is performed. Such a printer has been proposed to be configured to include an ink bag (liquid container) that is relatively large in a containing capacity of ink such that it is possible to stably and continuously supply ink to the liquid ejecting head even in a case where a relatively large amount of printing is performed (for example, see PTL 1).

In a recording apparatus disclosed in PTL 1, ink is supplied from an ink bag provided outside a housing through an ink supply tube to a liquid ejecting head provided inside the housing. In the recording apparatus, the housing and the ink bag are separately provided, and thus the housing and the ink bag need to individually move when a position of a printer is changed. In this respect, when a case made of a resin is mounted in the housing and the ink bag is accommodated in the case, it is possible for the housing and the ink bag to move together when the position of the printer is changed.

CITATION LIST

Patent Literature

PTL 1: Japanese Unexamined Patent Application Publication No. 2009-202346

SUMMARY OF INVENTION

Technical Problem

Incidentally, the ink bag has large and heavy containing capacity. Therefore, there is a concern that insufficient strength will be obtained in a method in which the case made of a resin is fastened to the housing made of a resin with a screw or the like.

Note that, this is a problem generally common not only in the ink jet type printer, but also in a recording apparatus in which a liquid supplied from a liquid container provided outside a housing to a recording portion provided inside the housing is ejected from the recording portion to a recording medium, and thereby recording is performed.

The present invention is made in consideration of the problem described above, and an object thereof is to provide a recording apparatus in which a case, in which a liquid container is accommodated, is reliably fixed to a housing with sufficient strength.

Solution to Problem

In order to achieve the above object, the present invention provides a recording apparatus including: a recording portion that ejects a liquid and performs recording on a recording medium; a housing in which the recording portion is accommodated; a liquid container in which a liquid that is supplied to the recording portion is contained; and a case in which the liquid container is accommodated. In the recording apparatus, a metal member is attached to at least one of a wall surface of the housing, which is formed of a resin, or a wall surface of the case, which is formed of a resin, and the metal member reinforces the strength of an attachment portion of the housing with the case.

In this configuration, since the metal member reinforces the strength of the attachment portion of the housing with the case, it is possible to increase the strength of attachment between the housing and the case, compared to a case where the case is directly attached to the housing.

In addition, in the recording apparatus, it is desirable that a first metal member is attached to the wall surface of the housing, which is formed of a resin, and a second metal member is attached to the wall surface of the case, which is formed of a resin. It is desirable that the first metal member and the second metal member are fastened to each other, and thereby the case is mounted in the housing, with at least one of the housing or the case interposed between the metal members.

In this configuration, the first metal member is attached to the wall surface of the housing, the second metal member is attached to the wall surface of the case, then, the first metal member and the second metal member are fastened to each other, and thereby the housing and the case are fixed, with at least one of the housing or the case interposed between the metal members. Therefore, compared to the case where the housing and the case are directly fastened to each other, the strength of the portion, in which the housing and the case are fixed, is increased to the extent that the sheet metal member is reinforced. In addition, since the housing and the case are fastened to each other via the sheet metal member, a load transmitted via a fastening member such as a screw is distributed to a broad range of the housing and the case via the sheet metal member, compared to the case where the housing and the case are directly fastened to each other.

In other words, in this configuration, it is possible to realize the recording apparatus in which the case, in which the liquid container is accommodated, is reliably fixed to the housing with sufficient strength.

In addition, in the recording apparatus, when the first metal member is attached to an inner surface of the housing and the second metal member is attached to an outer surface of the case, the case and the housing are fixed, with the wall surface of the housing interposed between the first metal member and the second metal member.

In addition, in the recording apparatus, it is desirable that the first metal member is press-fitted into an attachment hole provided in the wall surface of the housing, which is formed of a resin.

In this configuration, the first metal member is press-fitted into the attachment hole of the housing, thereby making it possible to easily perform assembly.

In addition, in the recording apparatus, it is desirable that an elongated hole is formed in the first metal member so as to have a length in a longitudinal direction that is different from a length in a transverse direction, and a plurality of projecting portions are formed on the second metal member so as to have a shape corresponding to the elongated hole and to be inserted into the elongated hole. It is desirable that at least one of a plurality of the first metal members attached to the housing is attached to have an orientation different from the other first metal members such that an orientation, in which the elongated hole extends, is different from that in the other first metal members. It is desirable that the plurality of projecting portions provided in the second metal member are inserted into the elongated holes in the plurality of first metal members attached to the housing, respectively.

In a case where the first metal members are all attached to have the same orientation, a direction, in which the elongated holes extend formed in the sheet metal members, is the same as each other. Therefore, even in a state in which the plurality of projecting portions of the second metal members are inserted into the elongated holes, respectively, such that the assembly is performed, there is a concern that the projecting portions will slide in the elongated holes and relative positions of the case and the housing to each other will be changed.

In this configuration, since at least one of the first metal members is attached to have an orientation different from the other first metal members, the directions, in which the elongated holes extend, are not all the same. Therefore, when the projecting portions are inserted into the elongated holes, it is possible to perform positioning in at least two directions. Hence, it is possible to reduce the positional shift of the case and the housing, and to perform positioning with higher accuracy.

In addition, in the recording apparatus, it is desirable that a liquid container holder, on which the liquid container is demountably mounted, is attached to the inner surface of the case, and a cutout hole is formed in a portion of the case, which is not overlapped with the liquid container holder. It is desirable that the second metal member is attached to the outer surface of the case, the first metal member and the second metal member are disposed such that screw holes formed in the metal members are overlapped with the cutout hole, and the first metal member and the second metal member are fastened to each other, with a screw inserted into the screw holes from the second metal member side.

In this configuration, the head of the screw, with which the case and the housing are fastened to each other, is in a state of being exposed through the cutout hole provided in the case. Therefore, it is possible to tighten or release the screw from the inside of the case even when the liquid container holder attached to the case is not removed. Therefore, it is possible to easily fasten or remove the first metal member and the second metal member.

In addition, in the recording apparatus, it is desirable that the second metal member is attached to the outer surface of the case and at least a part of the lower end of the second metal member is inserted into the housing from above such that the second metal member is supported by the housing from below.

In this configuration, since at least a part of the lower end of the second metal member attached to the case is supported by the housing from below, it is possible to more reliably fix, to the housing, the heavy case in which the liquid container is accommodated.

In addition, in the recording apparatus, it is desirable that a scanner portion, in which a scanner is accommodated, is provided in the housing. It is desirable that the second metal member attached to the outer surface of the case faces the scanner portion, and a gap is provided therebetween.

When the second metal member abuts on the wall surface of the scanner portion and the second metal member and the case are fastened to each other with the screw from the inner side of the case, the screw penetrating the second metal member is likely to interfere with a wall surface of the scanner portion. In this respect, when an interference preventative hole is provided in the wall surface of the scanner portion such that the screw does not interfere with the wall surface of the scanner portion, there is a concern that grit will enter the inside of the scanner portion through the interference preventative hole.

In this configuration, since the gap is provided between the second metal member and the scanner portion, it is difficult for the front end of the screw to interfere with the wall surface of the scanner portion even when the case and the second metal member are fastened to each other with the screw. Therefore, there is no need to provide the interference preventative hole in the wall surface of the scanner portion, and it is possible to prevent grit from entering the inside of the scanner portion.

DESCRIPTION OF EMBODIMENTS

First Embodiment

Hereinafter, the first embodiment of a recording apparatus will be described with reference to FIGS. 1 to 26. Note that the embodiment represents an example in which the recording apparatus is embodied in an ink jet type printer (hereinafter, simply referred to as a "printer").

Figure 1:
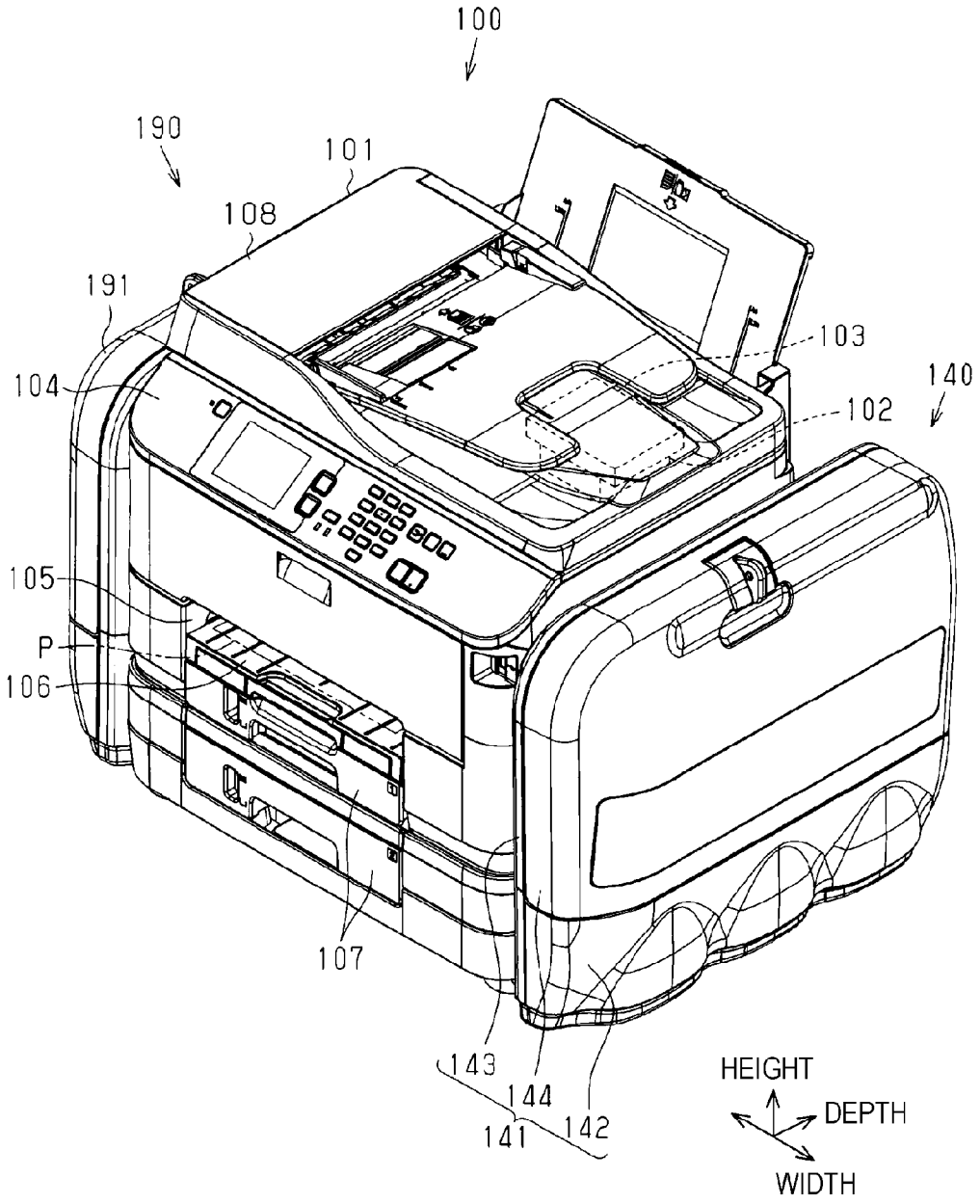
FIG. 1 is a perspective view of a recording apparatus of a first embodiment.

As shown in FIG. 1, the printer includes a recording unit 100 that ejects ink as an example of a liquid and performs recording on a sheet P as an example of a recording medium, and two liquid containing units 140 and 190 that supply ink to the recording unit 100.

A housing 101 made of a resin is provided in the recording unit 100, and a liquid ejecting head 102 as an example of a recording portion that ejects ink and performs recording on the sheet P or a carriage 103 that supports the liquid ejecting head 102 is accommodated in the housing 101. In addition, an operating panel 104 for operating the printer by a user is provided in the housing 101.

Note that, hereinafter, a direction, in which signage on a monitor, a button, or the like, in the operating panel 104 appears, is referred to as the front of the printer or the housing 101.

In addition, in FIG. 1, arrows represent a depth direction and a height direction of the printer, and a width direction as a direction orthogonal to the depth direction and the height direction of the printer, respectively.

The carriage 103 can reciprocate in the width direction of the printer inside the housing 101, and the liquid ejecting head 102 reciprocates in the width direction of the printer along with the movement of the carriage 103 and ejects ink, thereby performing recording (printing) on the sheet P.

In addition, a rectangular discharge port 105 is provided on the front surface of the housing 101 and, through the discharge port, the sheet P on which recording is performed inside the housing 101 is discharged outside the housing 101. The sheet P discharged from the discharge port 105 is mounted on a discharge tray 106. In addition, two upper and lower feed cassettes 107 are mounted to be demountably below the discharge tray 106 in the front surface of the housing 101. A plurality of sheets P can be contained in a state of being stacked in the feed cassettes 107.

In addition, a scanner portion 108 is provided on the housing 101 of the recording unit and a scanner that reads an image recorded on a document set at a predetermined reading position is accommodated in the scanner portion.

The first liquid containing unit 140 is attached to the right side surface of the housing 101. In addition, the second liquid containing unit 190 is attached to the left side surface of the housing 101.

Figure 2:
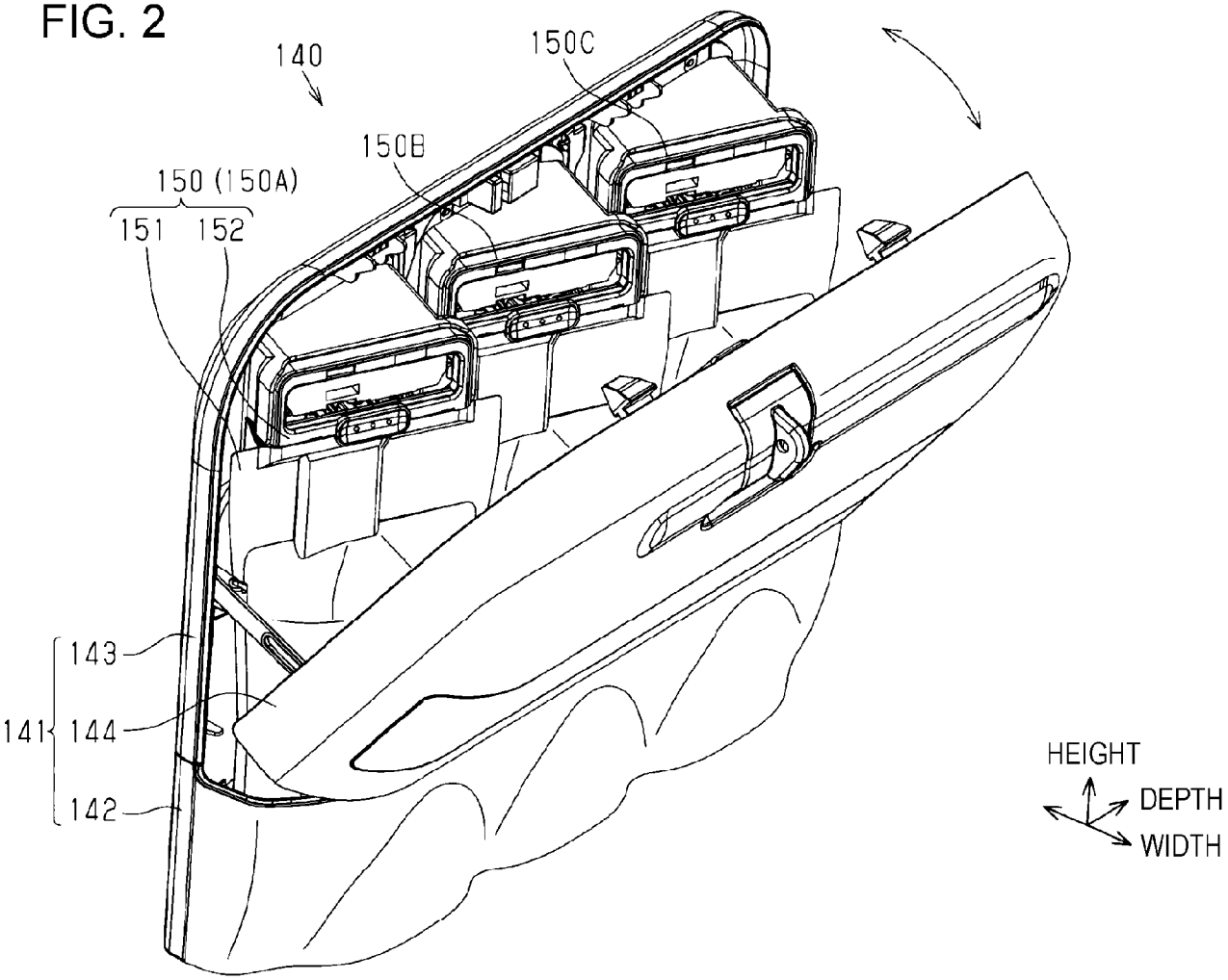
FIG. 2 is a perspective view of a first liquid containing unit, with a lid opened.

As shown in FIGS. 1 and 2, the first liquid containing unit 140 includes a case 141 made of a resin, and a plurality of liquid containers 150 accommodated in the case 141. The case 141 is configured to have a bottomed box-shaped bottom forming member 142 that forms the bottom of the case 141, a side-wall forming member 143 that is connected to an upper end of a sidewall of the bottom forming member 142 facing the housing 101, and a lid 144 that is rotatably connected to another upper end of the bottom forming member 142. The lid 144 abuts on or is separated from the upper end of the side-wall forming member 143, thereby opening and closing the case 141. Note that the case 141 is formed to have a substantially rectangular parallelepiped shape.

As shown in FIG. 2, the liquid container 150 accommodated in the case 141 includes an ink bag 151 formed of a flexible material, in which color ink is contained, and a handle 152 having a rectangular ring shape, which is fixed to an upper end portion of the ink bag 151. As the liquid container 150, a first liquid container 150A, a second liquid container 150B, and a third liquid container 150C are attached to the first liquid containing unit 140 in this order from the front side in the depth direction of the printer. For example, yellow ink is contained in the first liquid container 150A, magenta ink is contained in the second liquid container 150B, cyan ink is contained in the third liquid container 150C.

Figure 3:
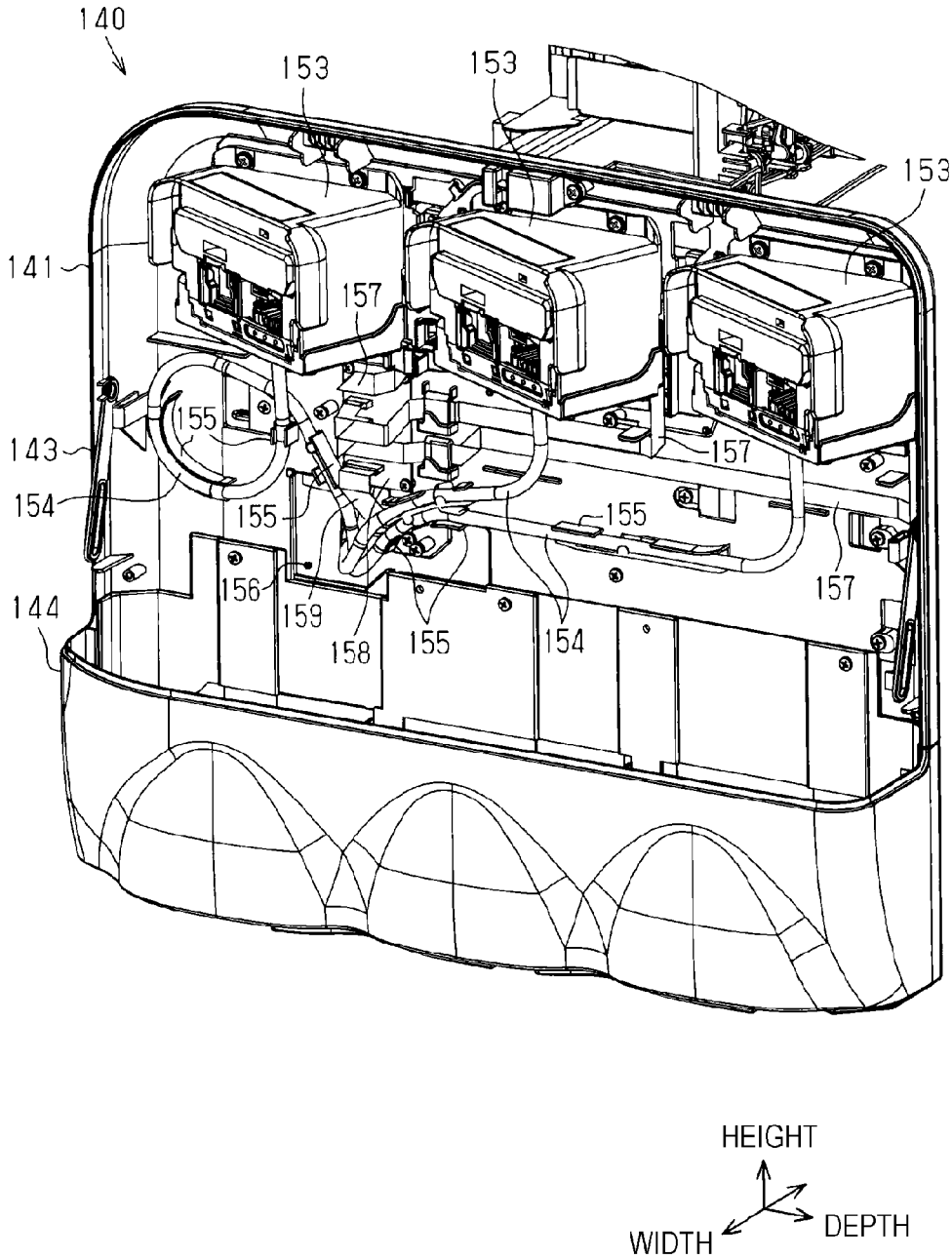
FIG. 3 is a perspective view of the first liquid containing unit, with the lid and a cover removed.

As shown in FIG. 3, a plurality of stays 153, to which the liquid containers 150 are attached, are provided on a wall surface of the side-wall forming member 143 on the inner side of the case 141. The handle 152 of the liquid container 150 is fitted into the stay 153, and thereby the liquid container 150 is detachably attached to the stay. In other words, the stay 153 functions as a liquid container holder that holds the liquid container 150. In addition, ink supply tubes 154 are connected to the stays 153, respectively. The ink supply tubes 154 are supported to have a curved shape by clamps 155 provided on an inner surface of the case 141, respectively, and are laid around to the outside of the case 141 through a tube inserting hole 156 provided in the side-wall forming member 143. Note that a cover is attached to the case 141 so as to cover the ink supply tubes 154 laid around in the case 141; however, FIG. 3 shows a state in which the cover and the lid 144 are removed.

The ink supply tubes 154 laid around to the outside of the case 141 are guided to the inside of the housing 101 of the recording unit 100. Therefore, when the liquid container 150 is attached to the stay 153, the ink contained in the liquid container 150 is supplied to the recording unit 100 through the ink supply tube 154. The ink supplied to the recording unit 100 is supplied to the liquid ejecting head 102 through an ink supply system provided in the recording unit 100 and is ejected from the liquid ejecting head 102.

In addition, one end of an individual cable 157 as a flexible flat cable is connected to each of the stays 153. The other end of the individual cable 157 is disconnectably connected to a relay substrate 158 provided on the inner surface of the case 141. An integrated cable 159 as a flexible flat cable is disconnectably connected to the relay substrate 158, and the integrated cable is electrically connected to each of the individual cables 157 through the relay substrate 158. The integrated cable 159 is laid around to the outside of the case 141 through the tube inserting hole 156 provided in the case 141 and is guided to the inside of the housing 101 of the recording unit 100 on the outside of the case 141. The integrated cable 159 guided to the inside of the recording unit 100 is connected to a main substrate via an information transmitting system provided inside the housing 101. In other words, the stays 153 and the main substrate are electrically connected through the cables or the like.

Here, an IC chip is provided in the handle 152 of the liquid container 150, and information on a remaining amount, kinds, or the like, of ink contained in the ink bag 151 is stored in the IC chip. Therefore, when the liquid container 150 is attached to the stay 153, the IC chip and the main substrate enter a state of being electrically connected, and the main substrate executes various types of control of the printer based on the information stored in the IC chip. Note that, when a remaining amount of ink contained in the liquid container 150 is equal to or less than a predetermined amount, the main substrate outputs a signal of urging replacement of the liquid container 150.

Figure 4:
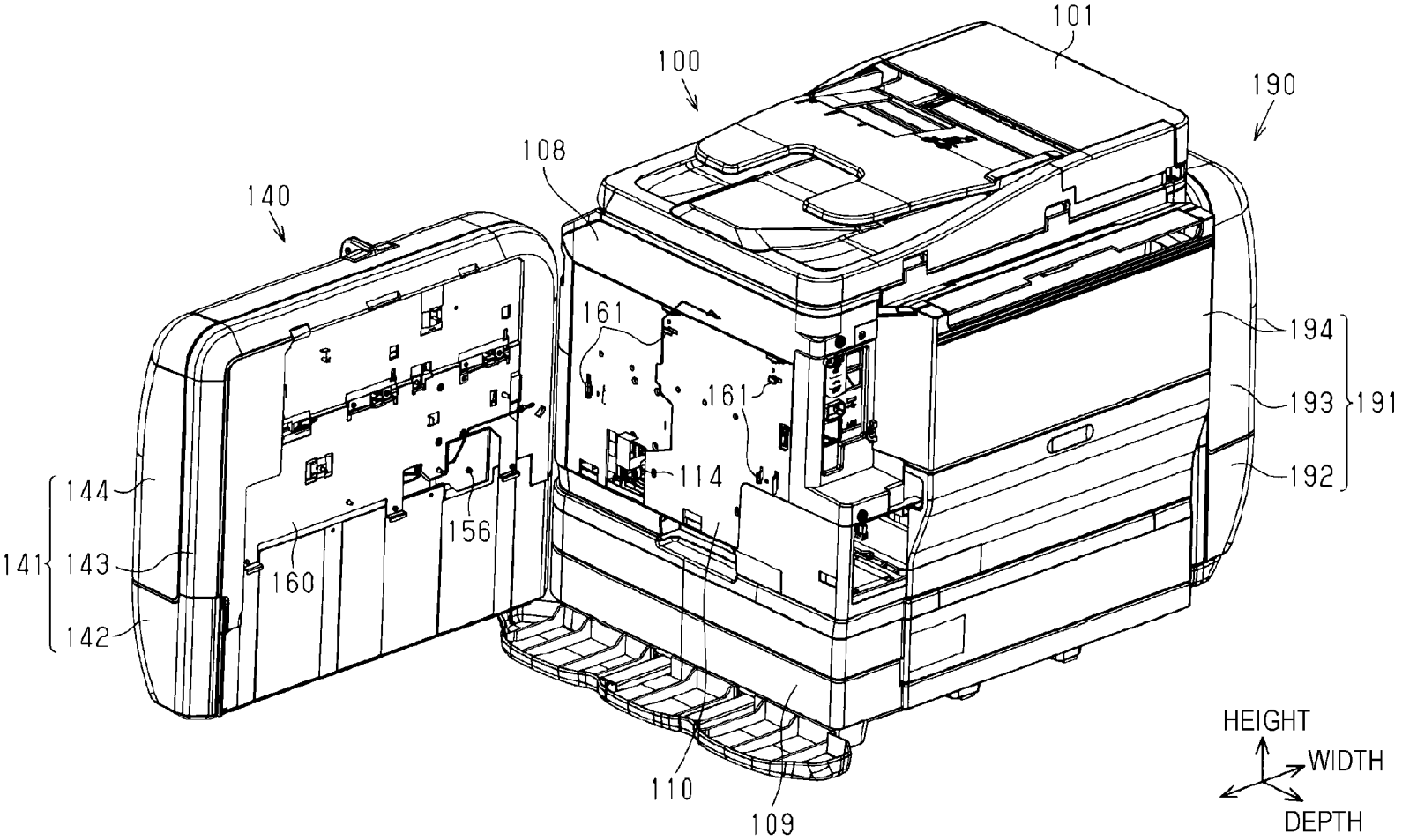
FIG. 4 is a perspective view of the recording apparatus showing a state in which the first liquid containing unit is rotated.

Incidentally, as shown in FIG. 4, outer sheet metal 160 is attached on a wall surface of the side-wall forming member 143, which is an outer surface facing the housing 101 of the case 141, and the outer sheet metal is an example of a first sheet metal member as a first metal member. In addition, inner sheet metal 161 is attached on an inner surface of the housing 101 of the printer, and the inner sheet metal is an example of a second sheet metal member as a second metal member. Then, the outer sheet metal 160 and the inner sheet metal 161 are fastened to each other with a screw, and thereby the case 141 is mounted on the housing 101.

Next, a structure of a fixing portion, in which the first liquid containing unit 140 is fixed to the right side surface of the housing 101, will be described in detail with reference to FIGS. 4 to 16.

As shown in FIG. 4, the housing 101 of the recording unit 100 is configured to include a base frame 109 as a base of the printer, a housing middle 110 that is attached on the base frame 109 so as to be supported on the base frame 109, and the scanner portion 108 provided on the housing middle 110, in which the scanner is accommodated.

Figure 5:
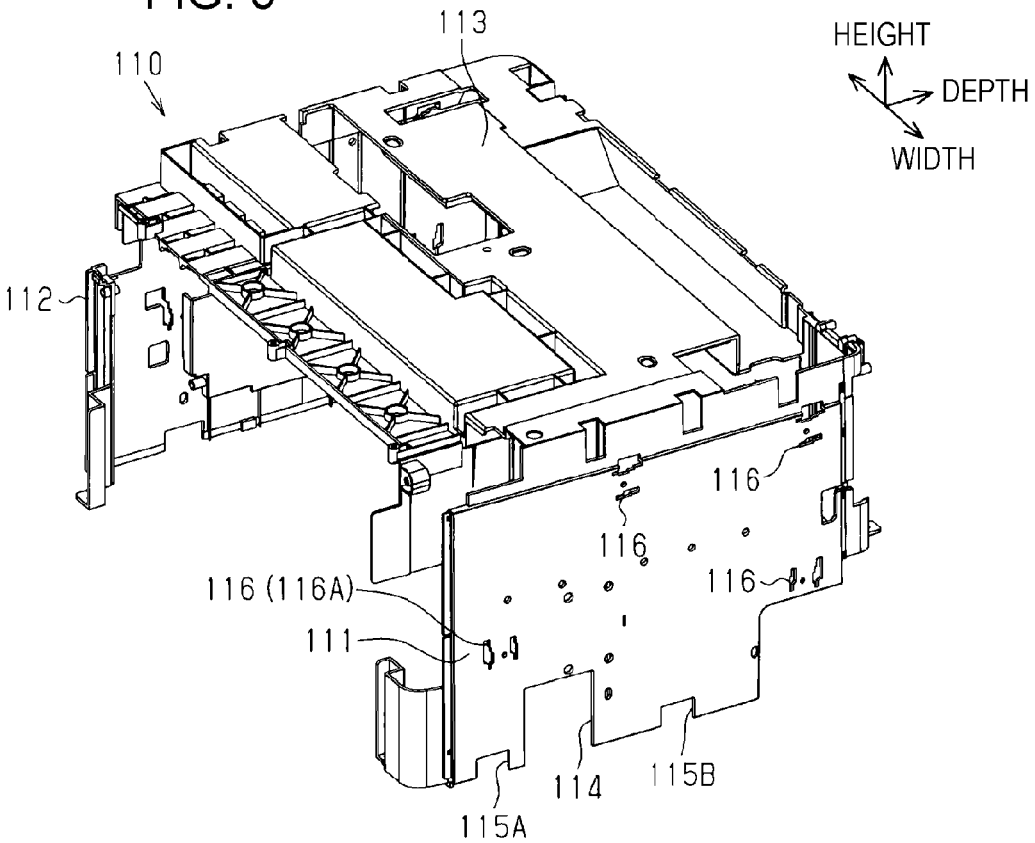
FIG. 5 is a perspective view of a housing middle constituting a housing.

As shown in FIG. 5, the housing middle 110 includes a right sidewall 111, a left sidewall 112, and a ceiling portion 113 connected to upper ends of both the sidewalls 111 and 112. Both the sidewalls 111 and 112 are exposed to the outside in a state of being assembled to the printer, and the first liquid containing unit 140 is mounted on the wall surface of the right sidewall 111.

A recessed portion 114 notched from a lower end of the right sidewall is provided in the right sidewall 111. As shown in FIG. 4, the recessed portion 114 is provided at a position facing the tube inserting hole 156 provided in the case 141 of the first liquid containing unit 140. Therefore, the ink supply tubes 154 and the integrated cable 159 laid around to the outside of the case 141 through the tube inserting hole 156 are guided to the inside of the housing 101 through the recessed portion 114 of the housing middle 110.

In addition, as shown in FIG. 5, two cutout portions 115A and 115B are formed in the lower end of the right sidewall 111 so as to interpose the recessed portion 114 therebetween.

Incidentally, in a case where the printer has a uniform width, the depth of the printer tends to be viewed to be narrow when the printer is viewed from the front. Therefore, the right sidewall 111 of the housing middle 110 is formed to have a slightly curved shape in the depth direction of the printer such that the length of the printer is decreased in the width direction thereof as the right sidewall is closer to the front side and is closer to the rear side deep in the printer, that is, such that the central portion projects outward in the width direction of the printer. In addition, the right sidewall 111 of the housing middle 110 is formed to have a slightly inclined shape with respect to the height direction of the printer such that the right sidewall is positioned further on the outer side as the right sidewall is closer to the lower side in the height direction of the printer, that is, such that the length of the printer is increased in the width direction thereof.

An attachment hole 116, into which the inner sheet metal 161 is press-fitted, is formed in the right sidewall 111 having such a shape. Note that the attachment holes 116 are formed at total four positions with two positions on the upper side and two positions on the lower side.

Next, a structure of the attachment hole 116 will be described in detail with reference to FIG. 6. Note that FIG. 6 is an enlarged view when an attachment hole 116A, which is positioned on the front side of the housing 101 in the depth direction of the two attachment holes 116 provided on the lower side, is viewed from the inner side of the housing 101.

Figure 6:
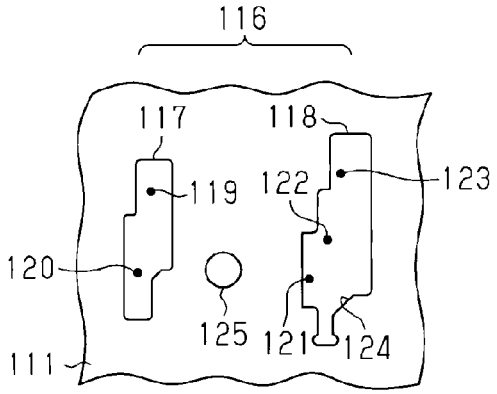
FIG. 6 is an enlarged view of an attachment hole provided in the housing middle.

As shown in FIG. 6, the attachment hole 116 is formed of a first attachment hole 117 that is positioned on the left side in FIG. 6 and extends in the vertical direction in FIG. 6, and a second attachment hole 118 that is positioned on the right side in FIG. 6 and has a length in the vertical direction longer than that of the first attachment hole 117. When an upper portion in the first attachment hole 117 is an upper hole portion 119, and a lower portion is a lower hole portion 120, a step is formed between the upper hole portion 119 and the lower hole portion 120, and the lower hole portion 120 is positioned on the left side, compared to the upper hole portion 119. In addition, the second attachment hole 118 has an inner hole portion 121 positioned on the first attachment hole 117 side, an attachment hole portion 122 longer than the inner hole portion 121 in the vertical direction, and an outer hole portion 123 extending more upward than the attachment hole portion 122. Note that positions of upper ends and lower ends of the inner hole portion 121, the attachment hole portion 122, and the outer hole portion 123, respectively, are different from one another, and steps are formed at connection portions. Note that a step 124 formed on the lower side in FIG. 6 is inclined, of the step between the attachment hole portion 122 and the outer hole portion 123. In addition, a substantially circular screw inserting hole 125 is provided between the first attachment hole 117 and the second attachment hole 118.

Figure 7:
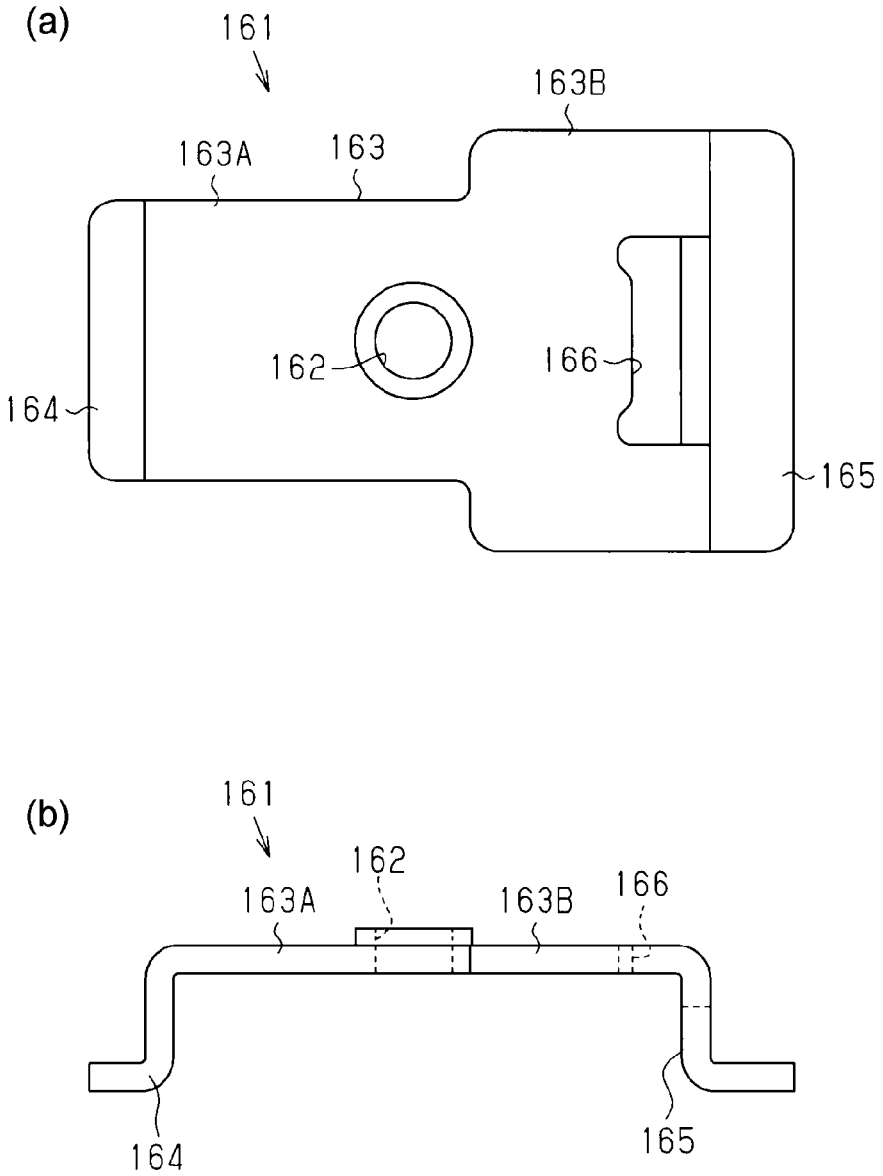
FIG. 7(*a*) is a top view of inner sheet metal and FIG. 7(*b*) is a side view of the inner sheet metal.

As shown in FIGS. 7(*a*) and 7(*b*), the inner sheet metal 161 has a top sheet portion 163 in which a screw hole 162 for fastening a screw is provided. As shown in FIG. 7(*a*), the top sheet portion 163 has a narrow width portion 163A in which the screw hole 162 is provided, and a wide width portion 163B having a width wider than the narrow width portion 163A. As shown in FIG. 7(*b*), a first holding portion 164 is provided in the narrow width portion 163A so as to extend substantially perpendicularly from the narrow width portion 163A and the end portion of the narrow width portion is bent outward. In addition, a second holding portion 165 is provided in the wide width portion 163B so as to extend substantially perpendicularly from the wide width portion 163B and the end portion of the wide width portion is bent outward. An elongated hole 166 is formed in the connection portion between the second holding portion 165 and the wide width portion 163B and the elongated hole extends at the center of the connection portion in a longitudinal direction (vertical direction in FIG. 7(*a*)) of the inner sheet metal 161. In other words, the elongated hole 166 has a length in the longitudinal direction (vertical direction in FIG. 7(*a*)) different from a length in the transverse direction (rightward-leftward direction in FIG. 7(*a*)).

Next, an example of an attachment method of the inner sheet metal 161 to the right sidewall 111 of the housing middle 110 will be described with reference to FIG. 8.

Figure 8:
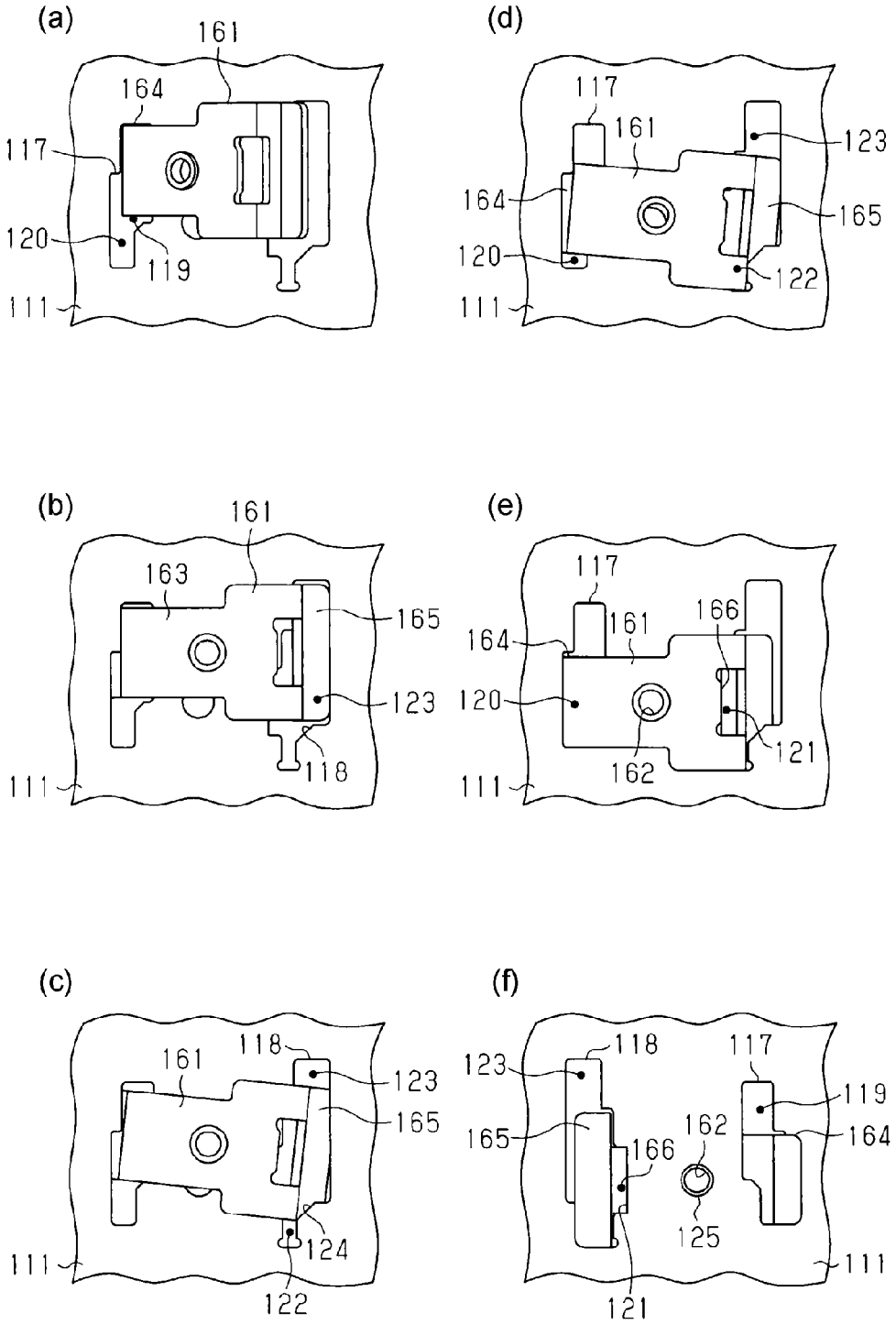
FIGS. 8(*a*) to 8(*f*) are views showing an example of an attachment method of the inner sheet metal to the housing middle.

When the inner sheet metal 161 is attached to the right sidewall 111 of the housing middle 110, as shown in FIG. 8(*a*), first, the first holding portion 164 of the inner sheet metal 161 is inserted into the upper hole portion 119 of the first attachment hole 117 provided in the right sidewall 111. As shown in FIG. 8(*b*), the inner sheet metal 161 is laid down such that the top sheet portion 163 of the inner sheet metal 161 and the wall surface of the right sidewall 111 face each other, and the second holding portion 165 of the inner sheet metal 161 is inserted into the outer hole portion 123 of the second attachment hole 118 provided in the right sidewall 111. At this time, since the step 124 between the outer hole portion 123 and the attachment hole portion 122 of the second attachment hole 118 is inclined, the inner sheet metal 161 is guided to the attachment hole portion 122 along the inclination. Then, as shown in FIG. 8(*c*), the second holding portion 165 side of the inner sheet metal 161 is caused to slide downward in FIG. 8. Then, as shown in FIG. 8(*d*), the entirety of the inner sheet metal 161 is caused to slide downward and the second holding portion 165 is pushed to the lower end of the attachment hole portion 122. Note that, when the inner sheet metal 161 is caused to slide downward, the first holding portion 164 of the inner sheet metal 161 is gradually inserted into the lower hole portion 120 of the first attachment hole 117. Then, as shown in FIG. 8(*e*), the first holding portion 164 is pushed to the lower end of the lower hole portion 120. As shown in FIGS. 8(*e*) and 8(*f*), when the inner sheet metal 161 is pushed to the lower end of the attachment hole 116, the screw hole 162 provided in the inner sheet metal 161 enters a state of being overlapped with a screw inserting hole 125 provided in the right sidewall 111, and the elongated hole 166 of the inner sheet metal 161 enters a state of being overlapped with the inner hole portion 121 of the second attachment hole 118. Note that FIG. 8(*f*) shows a state in which the state in FIG. 8(*e*) is viewed from the opposite side, that is, a state of being viewed from the outer side of the housing 101.

Here, a distance between the lower hole portion 120 of the first attachment hole 117 and the attachment hole portion 122 of the second attachment hole 118 is shorter than a length of the top sheet portion 163 of the inner sheet metal 161 in the transverse direction (rightward-leftward direction in FIG. 8). Therefore, when the inner sheet metal 161 is attached to the attachment hole 116, the inner sheet metal 161 enters a state of being interposed between the first attachment hole 117 and the second attachment hole 118. In addition, a step is formed in the first attachment hole 117 and the second attachment hole 118, and thus, when the inner sheet metal 161 is pushed to the lower end of the attachment hole 116, the upper end portion of the inner sheet metal 161 is caught on the step such that it is difficult for the inner sheet metal to be pulled out. Therefore, once the inner sheet metal 161 is press-fitted into the attachment hole 116 having such as configuration, the inner sheet metal 161 is held in the attachment hole 116 such that it is difficult for the inner sheet metal to fall off.

Figure 9:
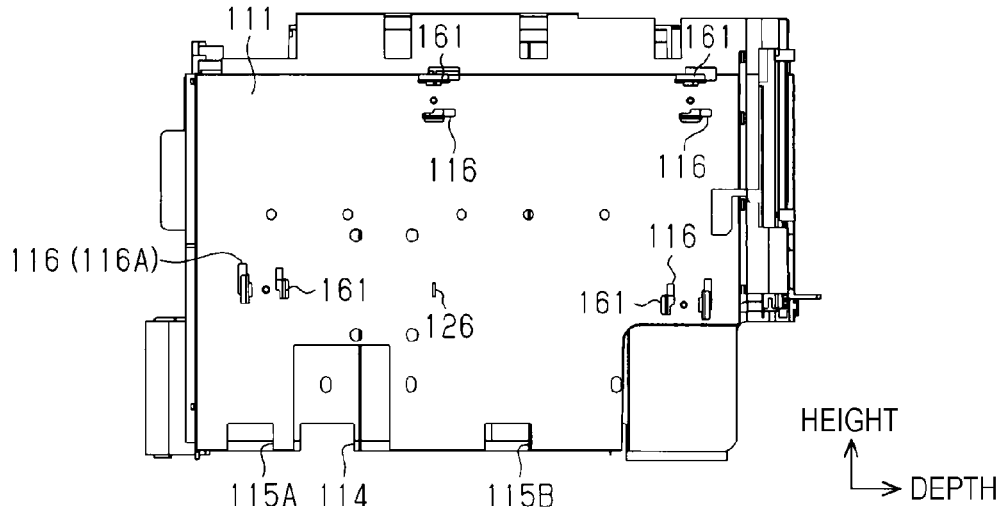
FIG. 9 is a left side view of the housing middle to which the inner sheet metal is attached.

FIG. 9 shows a state after pieces of the inner sheet metal 161 are attached to all of the attachment holes 116 of the right sidewall 111. As shown in FIG. 9, the two attachment holes 116 provided on the upper side are provided to have an orientation different from that of the attachment holes 116 provided on the upper side. Therefore, the pieces of inner sheet metal 161, which are press-fitted into the attachment holes 116 on the upper side, of the pieces of inner sheet metal 161 attached to the right sidewall 111, have the elongated hole 166 extending in an orientation different from that in the pieces of other inner sheet metal 161. More specifically, the elongated hole 166 of the inner sheet metal 161, which is press-fitted into the attachment hole 116 on the upper side, extends in the rightward-leftward direction (depth direction of the housing 101) in FIG. 9, and the elongated hole 166 of the inner sheet metal 161, which is press-fitted into the attachment hole 116 on the lower side, extends in the vertical direction (height direction of the housing 101) in FIG. 9. Note that a longitudinal hole 126 is provided in the right sidewall 111 so as to extend in the height direction of the housing 101 between the attachment holes 116 provided on the lower side.

Next, a configuration of the outer sheet metal 160, which is fastened to the inner sheet metal 161, will be described with reference to FIG. 10.

Figure 10:
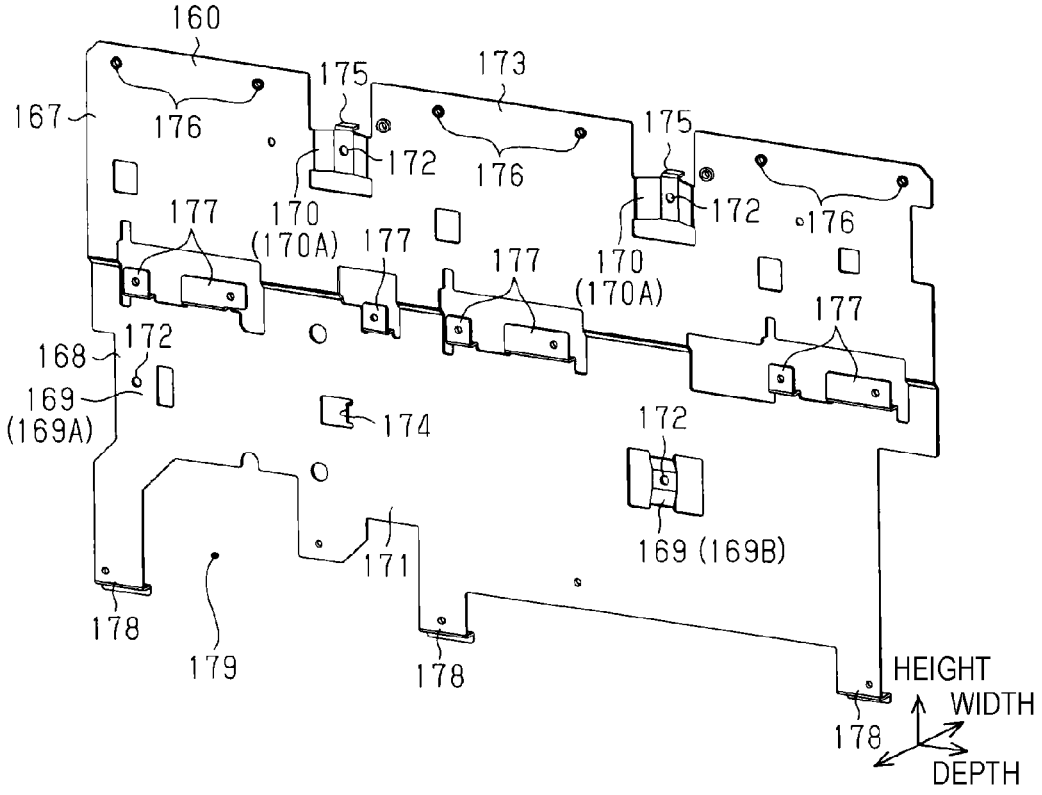
FIG. 10 is a perspective view of outer sheet metal that is attached to the first liquid containing unit.

As shown in FIG. 10, the outer sheet metal 160 has an upper sheet portion 167 positioned on the upper side of the printer in the height direction, and a lower sheet portion 168 positioned on the lower side. The upper sheet portion 167 is connected to the lower sheet portion 168 and the upper sheet portion 167 is positioned on the outer side with respect to the lower sheet portion 168 in the width direction of the printer. A fastening portion 169 is provided in the lower sheet portion 168 so as to be fastened, with a screw, to the inner sheet metal 161 provided on the lower side of the right sidewall 111 of the housing middle 110. The fastening portion 169 has a first fastening portion 169A and a second fastening portion 169B which are aligned in this order from the front side in the depth direction of the printer. In addition, a fastening portion 170 is provided in the upper sheet portion 167 so as to be fastened, with a screw, to the inner sheet metal 161 provided on the upper side of the right sidewall 111 of the housing middle 110. The fastening portion 170 has a third fastening portion 170A and a fourth fastening portion 170B which are aligned in this order from the front side in the depth direction of the printer.

The first fastening portion 169A has a circular screw hole 172 provided in a reference surface 171 of the lower sheet portion 168. In addition, the second fastening portion 169B projects inward from the reference surface 171 of the lower sheet portion 168 in the width direction of the printer, and a screw hole 172 is provided on the bottom thereof.

Meanwhile, the third fastening portion 170A provided in the upper sheet portion 167 projects inward from the reference surface 173 of the upper sheet portion 167 in the width direction of the printer. Note that a degree of the projecting is the same as a size of the step between the reference surface 171 of the lower sheet portion 168 and the reference surface 173 of the upper sheet portion 167. Therefore, positions of the screw hole 172 provided in the bottom of the third fastening portion 170A and the screw hole 172 of the first fastening portion 169A are aligned in a thickness direction of the outer sheet metal 160, which is a direction perpendicular to the reference surface 171 and the reference surface 173.

In addition, the fourth fastening portion 170B projects inward from the reference surface 173 of the upper sheet portion 167 in the width direction of the printer. Note that a degree of the projecting is larger than the third fastening portion 170A, and the bottom of the fourth fastening portion 170B is positioned inward from the reference surface 171 of the lower sheet portion 168 in the width direction of the printer. Positions of the screw hole 172 provided in the bottom of the fourth fastening portion 170B and the screw hole 172 provided in the bottom of the second fastening portion 169B are aligned in the thickness direction of the outer sheet metal 160.

In addition, a projecting portion 174 is provided between the first fastening portion 169A and the second fastening portion 169B, has a shape corresponding to the longitudinal hole 126 provided in the right sidewall 111 of the housing middle 110 so as to extend in the height direction of the printer, and projects inward in the width direction of the printer. In addition, projecting portions 175 are provided on the upper ends of the third fastening portion 170A and the fourth fastening portion 170B, respectively, has a shape corresponding to the elongated hole 166 of the inner sheet metal 161 so as to extend in the width direction of the printer, and projects inward in the width direction of the printer.

In addition, a plurality of bosses 176 are provided in the upper end portion of the outer sheet metal 160 so as to be screwed with screws penetrating through the case 141 when the stays 153 are fastened to the inner surface of the case 141 with the screws. In addition, a plurality of screwing portions 177 are provided in the upper end portion of the lower sheet portion 168 of the outer sheet metal 160 so as to be bent outward in the width direction of the printer. Meanwhile, a plurality of insertion portions 178 are provided in the lower end portion of the lower sheet portion 168 and are bent inward from the reference surface 171 of the lower sheet portion 168 in the width direction of the printer so as to have front ends thereof extending downward. A notch 179 is formed in a portion on the front side in the depth direction of the printer.

Next, an example of a fastening method between the outer sheet metal 160 and the inner sheet metal 161 will be described with reference to FIG. 11.

Figure 11:
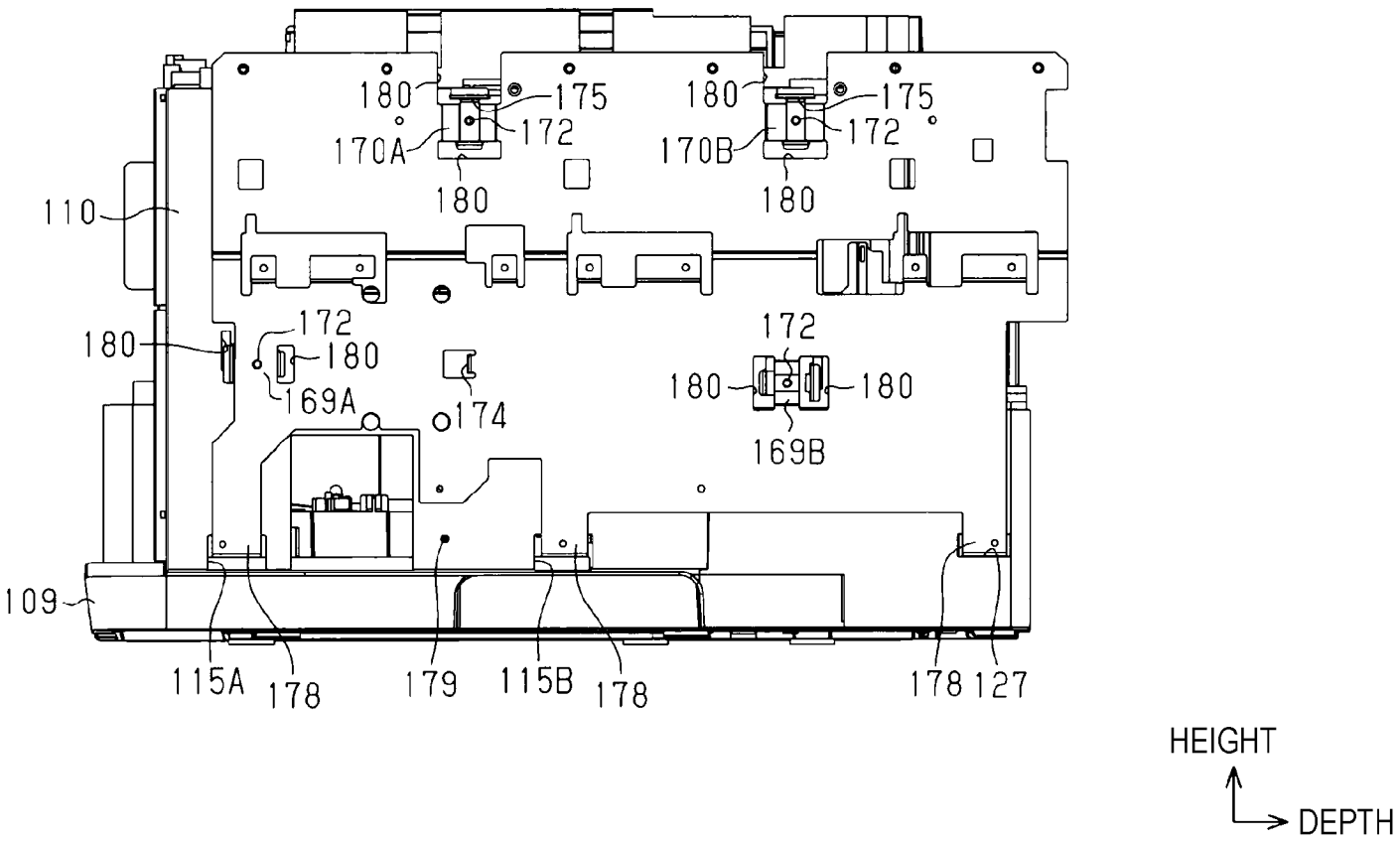
FIG. 11 is a left side view of the housing middle showing a state in which the inner sheet metal and the outer sheet metal are fastened to each other.

As shown in FIG. 11, with the lower end of the housing middle 110 supported by the base frame 109, first, the plurality of insertion portions 178 provided on the lower end of the outer sheet metal 160 are inserted into the cutout portions 115A and 115B, respectively, provided on the lower end of the right sidewall 111 of the housing middle 110. In addition, one of the plurality of insertion portions 178 of the outer sheet metal 160 is inserted into a support hole 127 provided in the base frame 109. In this manner, the lower end of the outer sheet metal 160 is supported by the housing 101 from below. Then, the projecting portions 175 provided in the third fastening portion 170A and the fourth fastening portion 170B of the outer sheet metal 160 are inserted into the elongated holes 166 of the two pieces of inner sheet metal 161 provided on the upper side of the right sidewall 111 of the housing middle 110. Since the inner hole portion 121 provided in the attachment hole 116 of the right sidewall 111 is overlapped with the elongated hole 166 of the inner sheet metal 161, the projecting portion 175 inserted into the elongated hole 166 is also inserted into the inner hole portion 121 and penetrates through the right sidewall 111 of the housing middle 110.

In addition, the projecting portion 174 provided between the first fastening portion 169A and the second fastening portion 169B of the outer sheet metal 160 is inserted into the longitudinal hole 126 provided in the right sidewall 111 of the housing middle 110. Since the elongated hole 166 of the inner sheet metal 161 and the longitudinal hole 126 of the right sidewall 111 extend in different directions from each other, the projecting portions 174 and 175 are inserted into the holes, respectively, thereby making it possible to position the outer sheet metal 160 with respect to the right sidewall 111 and the inner sheet metal 161 in both the height direction and the depth direction of the printer. Then, screws are inserted, from the outer sheet metal 160 side, into the screw holes 172 of the first to fourth fastening portions, into the screw inserting holes 125 of the housing middle 110, and into the screw holes 162 of the inner sheet metal 161 such that the inner sheet metal 161 and the outer sheet metal 160 are fastened to each other. When the inner sheet metal 161 and the outer sheet metal 160 are fastened to each other, the right sidewall 111 of the housing middle 110 enters a state of being interposed between the outer sheet metal 160 and the inner sheet metal 161.

In addition, the front ends of the first holding portion 164 and the second holding portion 165 of the inner sheet metal 161 projects outward from the wall surface of the right sidewall 111. A plurality of hole portions 180 are provided in a portion of the outer sheet metal 160 which is overlapped with the front ends of the first holding portion 164 and the second holding portion 165 of the inner sheet metal 161. Therefore, in the state in which the outer sheet metal 160 and the inner sheet metal 161 are fastened to each other, the front end of the inner sheet metal 161 is exposed through the hole portion 180 of the outer sheet metal 160.

In this state, the notch 179 provided on the lower end of the outer sheet metal 160 is overlapped with the recessed portion 114 of the right sidewall 111 of the housing middle 110, that is, the tube inserting hole 156 of the case 141. Therefore, when the outer sheet metal 160 and the inner sheet metal 161 are fastened to each other, it is possible to lead the ink supply tubes 154 or the integrated cable into the inside of the housing 101 through the notch 179 and the tube inserting hole 156 without covering the tube inserting hole 156 with the outer sheet metal 160.

Figure 12:
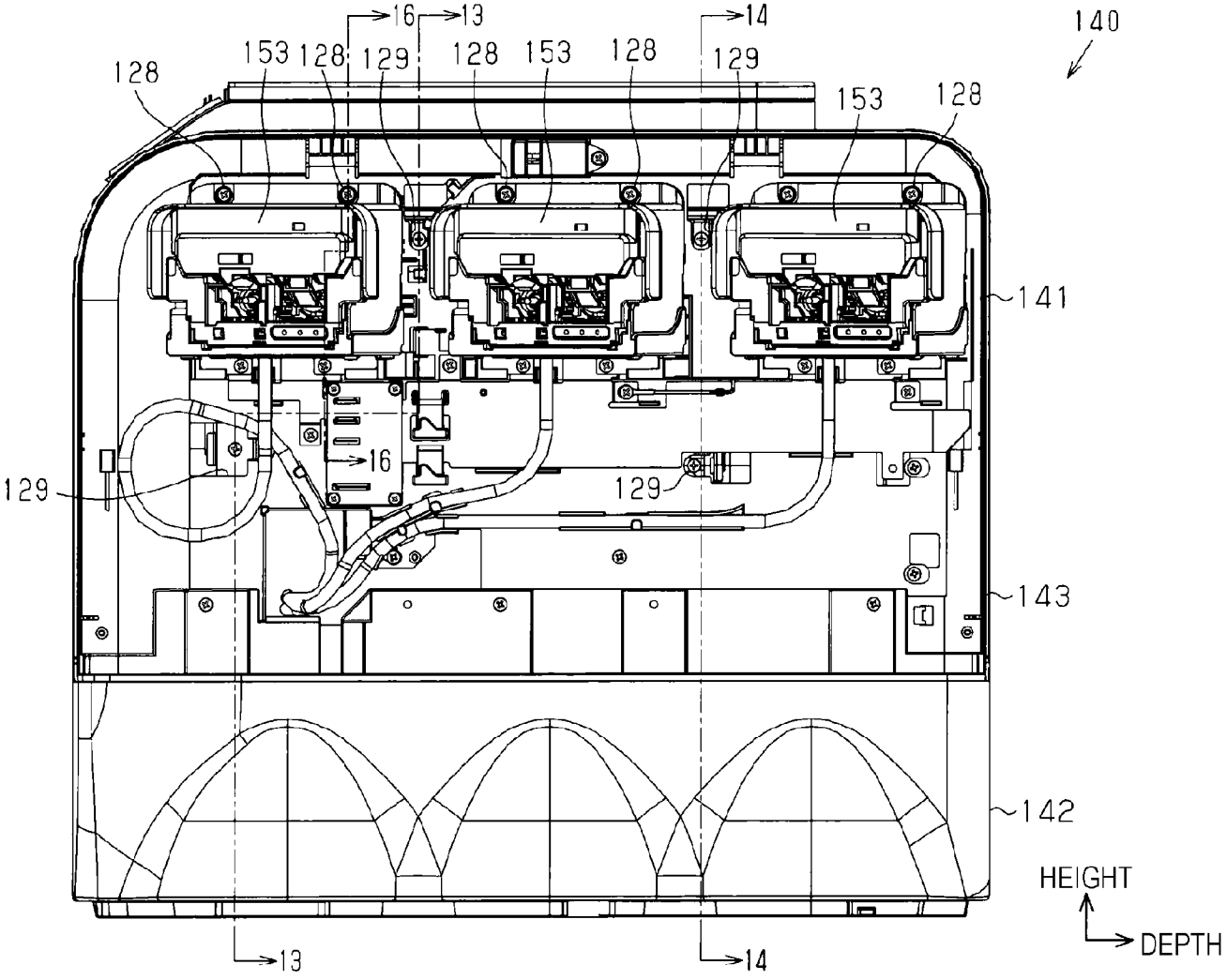
FIG. 12 is a front view of the first liquid containing unit, with the lid and the cover removed.

As shown in FIG. 12, the case 141 of the first liquid containing unit 140 is fastened to the outer sheet metal 160 with a plurality of screws inserted from the inner side of the case 141. In addition, the plurality of stays 153 are fixed to the inner surface of the case 141. The screw 128, with which the upper end of the stay 153 is fixed to the case 141, penetrates through the case 141 and is screwed into the boss 176 provided in the outer sheet metal 160. Therefore, the screw 128, with which the upper end portion of the stay 153 is fixed to the case 141, not only fixes the case 141 and the stay 153 to each other, but also the case 141 and the outer sheet metal 160 to each other.

In addition, a hole is provided in a portion of the case 141 facing the lower end portion of the stay 153, and thus the screwing portion 177 of the outer sheet metal 160 is exposed through the portion. The lower end portion of the stay 153 is fastened to the screwing portion 177 with a screw.

In addition, a cutout hole 129 is formed in a portion of the side-wall forming member 143 of the case 141 which is not overlapped with the stays 153. The outer sheet metal 160 and the inner sheet metal 161 are disposed such that the screw holes 162 and 172 formed therein, respectively, are overlapped with the cutout hole 129, and the outer sheet metal 160 and the inner sheet metal 161 are fastened to each other with a screw 131 inserted into the screw holes 162 and 172 from the outer sheet metal 160 side. Therefore, the head of the screw 131, with which the case 141 and the housing 101 are fastened to each other, enters a state of being exposed though the cutout hole 129 provided in the case 141.

In the first liquid containing unit 140 having this configuration, it is possible to tighten or release, from the inside of the case 141, the screw 131, with which the outer sheet metal 160 and the inner sheet metal 161 are fastened to each other, without detaching the stay 153 attached to the case 141. Therefore, only with the release of the outer sheet metal 160 and the inner sheet metal 161 from the fastening, as shown in FIG. 4, it is possible to detach the case 141 from the housing 101, with the outer sheet metal 160 fixed to the outer surface of the case 141. Thus, workability is improved when maintenance or the like of the recording unit 100 is performed.

Next, a structure of a fixing portion of the housing 101 and the case 141 will be described with reference to FIGS. 13 and 14. Note that FIG. 13 is a view schematically showing a structure of a cross section taken along a line connecting the first fastening portion 169A and the third fastening portion 170A in FIG. 12, and FIG. 14 is a view schematically showing a structure of a cross section taken along a line connecting the second fastening portion 169B and the fourth fastening portion 170B in FIG. 12.

Figure 13:
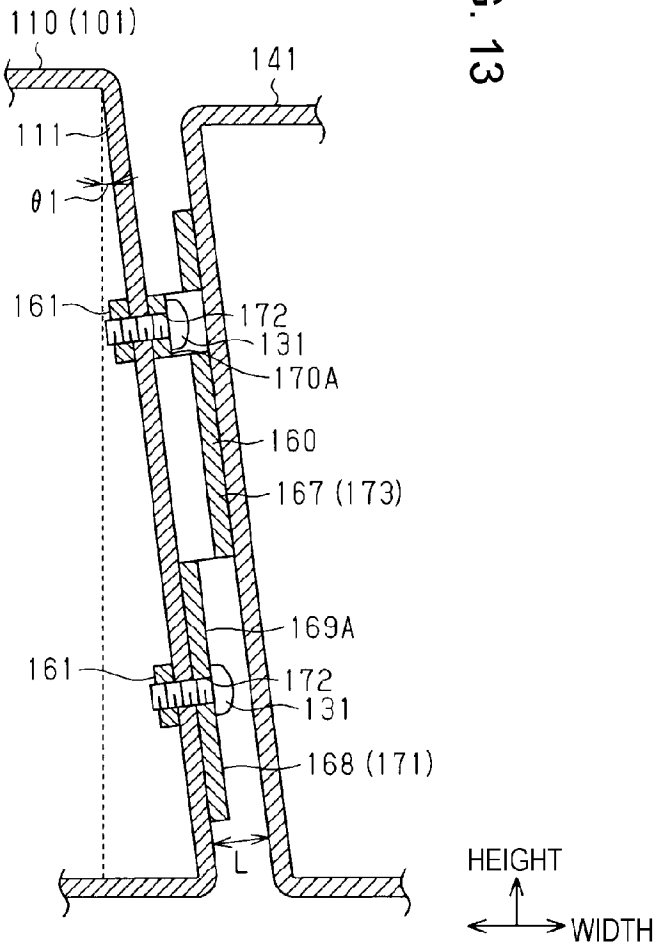
FIG. 13 is a view schematically showing a cross section taken along line 13-13 in FIG. 12.

As shown in FIG. 13, the right sidewall 111 of the housing middle 110 is inclined by an inclination angle θ1 with respect to the height direction of the printer so as to be positioned further on the outer side as the right sidewall is closer to the lower side with respect to the height direction of the printer. Also, the inner sheet metal 161 is attached to the right sidewall 111 from the inner side of the housing 101. In other words, the inner sheet metal 161 is attached to the inner surface of the housing middle 110.

In addition, since the first fastening portion 169A is provided in the reference surface 171 of the lower sheet portion 168 in the outer sheet metal 160, the lower sheet portion 168 of the outer sheet metal 160 abuts on the outer surface of the housing middle 110 and is fastened to each other with the screw 131 in a state of being separated from the outer surface of the case 141. The upper sheet portion 167 connected to the lower sheet portion 168 is positioned on the outer side from the lower sheet portion 168 in the width direction of the printer. Therefore, the upper sheet portion 167 is separated from the outer surface of the housing middle 110 and abuts on the outer surface of the case 141. The third fastening portion 170A projects from the upper sheet portion 167 toward the housing middle 110 side, and is fastened to the inner sheet metal 161 with the screw 131 with the bottom of the third fastening portion abutting on the outer surface of the housing middle 110. As described above, a degree of the projecting of the third fastening portion 170A from the reference surface 173 is the same as the size of the step between the reference surface 171 and the reference surface 173 such that positions of the screw hole 172 provided in the bottom of the third fastening portion 170A and the screw hole 172 of the first fastening portion 169A are aligned in the thickness direction of the outer sheet metal 160. Therefore, distances from the outer surface of the case 141 abutting on the upper sheet portion 167 to the first fastening portion 169A and the third fastening portion 170A are the same as each other. Thus, the case 141 of the first liquid containing unit 140 is mounted on the housing 101 in a state of being inclined by the same angle as the inclination angle θ1 with respect to the height direction of the printer, so as to be positioned over the right-side surface of the housing 101 which is inclined with respect to the height direction of the printer.

Figure 14:
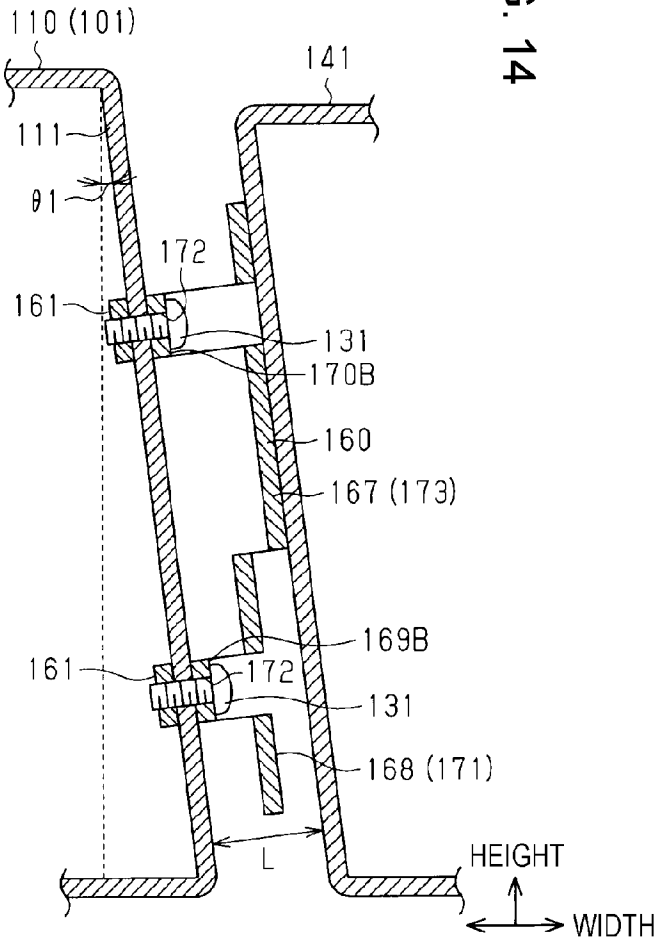
FIG. 14 is a view schematically showing a cross section taken along line 14-14 in FIG. 12.
Figure 15:
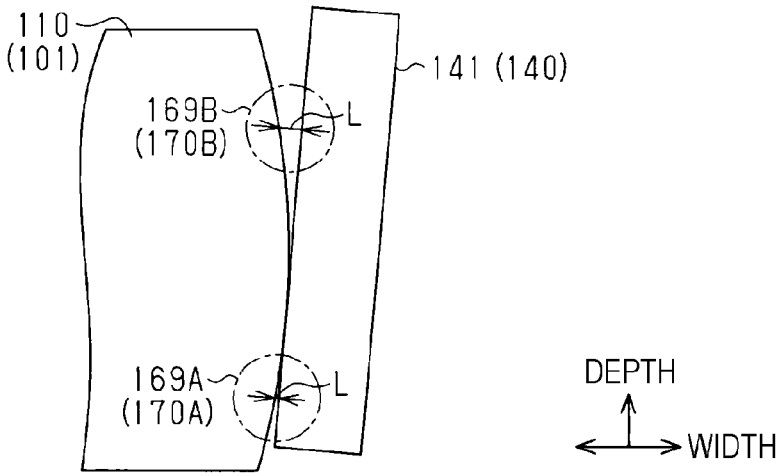
FIG. 15 is a view schematically showing a state of the housing middle and the first liquid containing unit when the recording apparatus is viewed from above.

Meanwhile, as shown in FIG. 14, since the second fastening portion 169B is positioned on the inner side from the reference surface 171 of the lower sheet portion 168 in the width direction of the printer, in a position where the second fastening portion 169B is provided, the lower sheet portion 168 enters a state of being separated from the outer surface of the housing middle 110. In addition, as described above, a degree of the projecting of the fourth fastening portion 170B from the reference surface 173 is larger than the degree of the projecting of the third fastening portion 170A, and positions of the screw hole 172 provided in the bottom of the fourth fastening portion 170B and the screw hole 172 provided in the bottom of the second fastening portion 169B are aligned in the thickness direction of the outer sheet metal 160. Thus, as shown in FIG. 15, a distance L from the housing 101 to the case 141 is increased in a portion in which the second fastening portion 169B and the fourth fastening portion 170B are provided, compared to the portion in which the first fastening portion 169A and the third fastening portion 170A are provided. In other words, the case 141 is mounted on the housing 101 in a state of being inclined with respect to the height direction of the printer such that the outer surface of the case 141 is positioned further to the inner side in the width direction of the printer as the outer surface is closer to the front side in the depth direction of the printer. Therefore, a gap between the housing 101 and the case 141 is decreased when viewed from the front, compared to a case where the case 141 is mounted without being inclined with respect to the depth direction of the printer.

In addition, since the case 141 is formed to have a substantially rectangular parallelepiped shape, the width of the printer including the case 141 is increased as the width is measured at a position deeper in the depth direction of the printer when the case 141 is inclined in the depth direction of the printer as described above. Therefore, the printer is unlikely to be viewed to have a recessed sidewall when viewed from the front.

Figure 16:
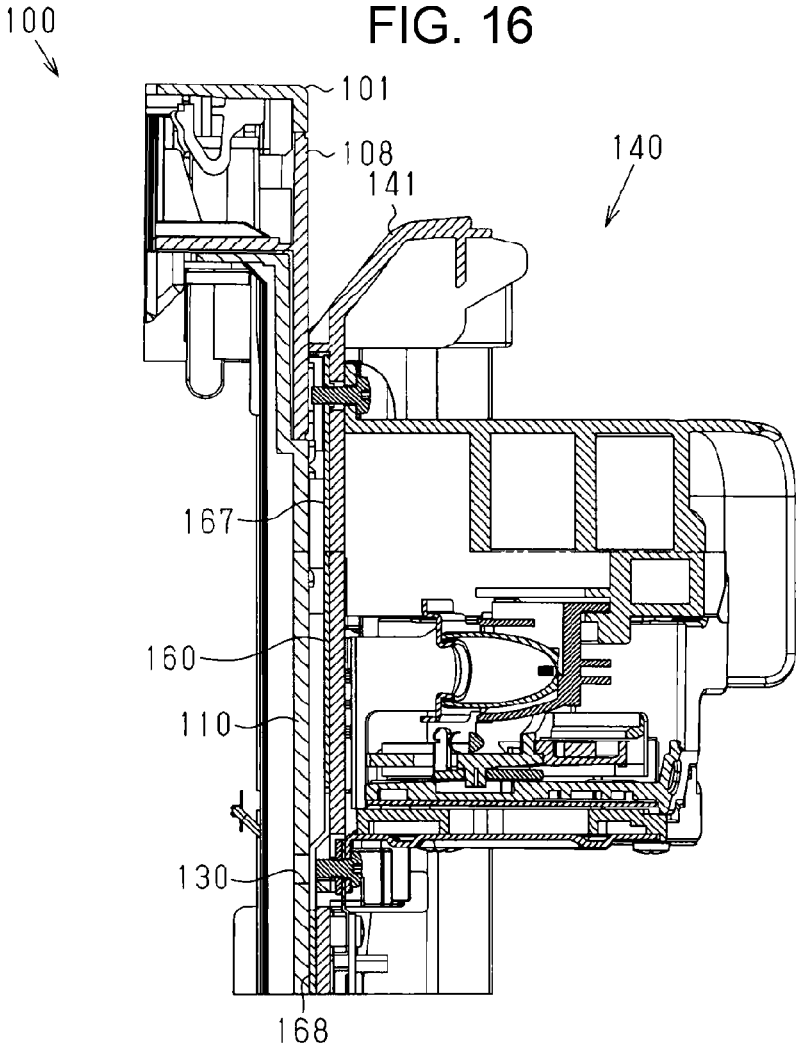
FIG. 16 is a sectional view taken along line 16-16 in FIG. 12.

In addition, as shown in FIG. 16, the scanner portion 108 provided above the housing 101 faces the outer sheet metal 160 which is attached to the outer surface of the case 141, and, since the upper sheet portion 167 of the outer sheet metal 160 is provided to be bent toward the case 141 side, a gap is provided between the scanner portion 108 and the outer sheet metal 160.

When the outer sheet metal 160 abuts on the wall surface of the housing 101, the screw penetrating the outer sheet metal 160 is likely to interfere with the wall surface of the housing 101 when the outer sheet metal 160 and the case 141 are fastened to each other with the screw from the inner side of the case 141. In this respect, in the embodiment, an interference preventative hole 130 is provided in the wall surface of the housing middle 110. Therefore, even when the case 141 is fastened, with the screw, to the lower sheet portion 168 of the outer sheet metal 160 that abuts on the wall surface of the housing middle 110, the screw does not interfere with the wall surface of the housing middle 110.

Meanwhile, since the gap is formed between the scanner portion 108 and the outer sheet metal 160, the front end of the screw is unlikely to interfere with the wall surface of the scanner portion 108 even when the case 141 and the outer sheet metal 160 are fastened to each other with the screw.

Therefore, the interference preventative hole 130 is not provided in the wall surface of the scanner portion 108.

Next, the second liquid containing unit 190 which is attached to the left-side surface of the housing 101 will be described.

As shown in FIGS. 1 and 4, the second liquid containing unit 190 includes a case 191 made of a resin, similar to the first liquid containing unit 140. The case 191 is configured to have a bottomed box-shaped bottom forming member 192 that forms the bottom of the case 191, a side-wall forming member 193 that is connected to an upper end of a sidewall of the bottom forming member 192 facing the housing 101, and a lid 194 that is rotatably connected to another upper end of the bottom forming member 192. The lid 194 abuts on or is separated from the upper end of the side-wall forming member 193, thereby opening and closing the case 191. Note that the case 191 is formed to have a substantially rectangular parallelepiped shape.

The liquid container is accommodated in the case 191. The liquid container contains, for example, black ink, and includes an ink bag formed of a flexible material having a capacity larger than the liquid container 150 provided in the first liquid containing unit 140, and a handle having a rectangular ring shape, which is fixed to an upper end portion of the ink bag.

Figure 17:
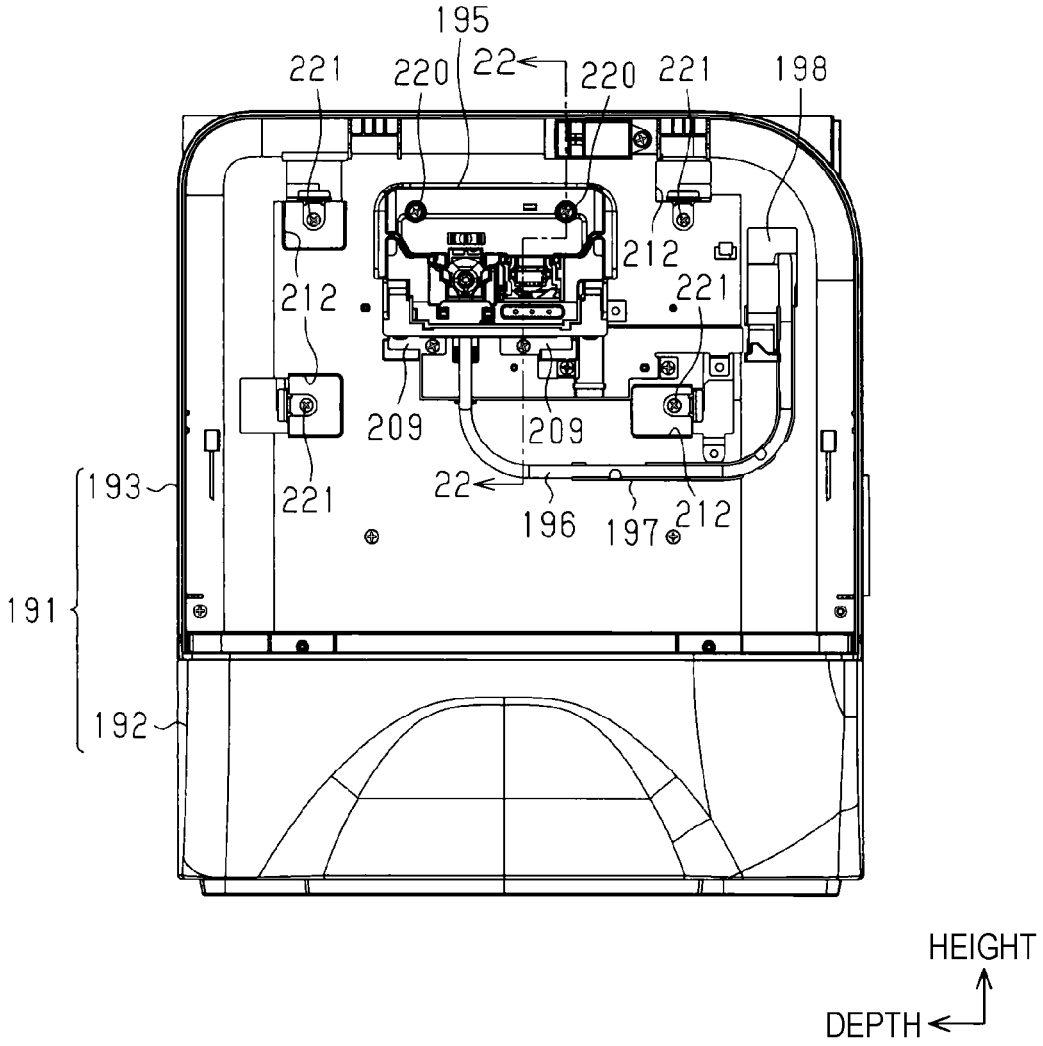
FIG. 17 is a front view of a second liquid containing unit, with a lid and a cover removed.

As shown in FIG. 17, one stay 195, to which the liquid container is attached, is fixed to a wall surface of the side-wall forming member 193 on the inner side of the case 191. The handle of the liquid container is fitted into the stay 195, and thereby the liquid container is detachably attached to the stay. In other words, the stay 195 functions as a liquid container holder that holds the liquid container. In addition, an ink supply tube 196 is connected to the stay 195. The ink supply tube 196 is supported to have a curved shape by a clamp 197 provided on an inner surface of the case 191, and is laid around to the outside of the case 191 through a tube inserting hole 198 provided in the side-wall forming member 193 on the front side in the depth direction of the printer. Note that a cover is attached to the case 191 so as to cover the ink supply tube 196 laid around in the case 191; however, FIG. 17 shows a state in which the cover and the lid 194 are removed.

The ink supply tube 196 laid around to the outside of the case 191 is guided to the inside of the housing 101 of the recording unit 100. Therefore, when the liquid container is attached to the stay 195, the ink contained in the liquid container is supplied to the recording unit 100 through the ink supply tube 196. The ink supplied to the recording unit 100 is supplied to the liquid ejecting head 102 through an ink supply system provided in the recording unit 100 and is ejected from the liquid ejecting head 102.

In addition, one end of an individual cable as a flexible flat cable is connected to the stay 195. The individual cable is laid around to the outside of the case 191 through the tube inserting hole 198 provided in the case 191 and is guided to the inside of the housing 101 of the recording unit 100 on the outside of the case 191. The individual cable guided to the inside of the recording unit 100 is connected to a main substrate via an information transmitting system provided inside the housing 101.

An IC chip is also provided in the handle of the liquid container which is attached to the stay 195, and information on a remaining amount, kinds, or the like, of ink contained in the ink bag is stored in the IC chip. Therefore, when the liquid container is attached to the stay 195, the IC chip and the main substrate enter a state of being electrically connected, and the main substrate executes various types of control of the printer based on the information stored in the IC chip. Note that, when a remaining amount of ink contained in the liquid container, which is provided in the second liquid containing unit 190, is equal to or less than a predetermined amount, the main substrate outputs a signal of urging replacement of the liquid container.

Similar to the first liquid containing unit 140, the second liquid containing unit 190 is mounted on the housing 101, by fastening, with screws, outer sheet metal 199 (refer to FIG. 20) attached on an outer surface of the case 191, and inner sheet metal 161 attached to the right-side surface of the housing 101 from the inner side. Note that the inner sheet metal 161 attached on the right-side surface of the housing 101 is the same as the inner sheet metal 161 attached to the right-side surface of the housing 101. In addition, as described above, the left sidewall 112 of the housing middle 110 constituting the housing 101 of the recording unit 100 is exposed to the outside in a state of being assembled to the printer, and the second liquid containing unit 190 is mounted on the wall surface of the left sidewall 112.

Figure 18:
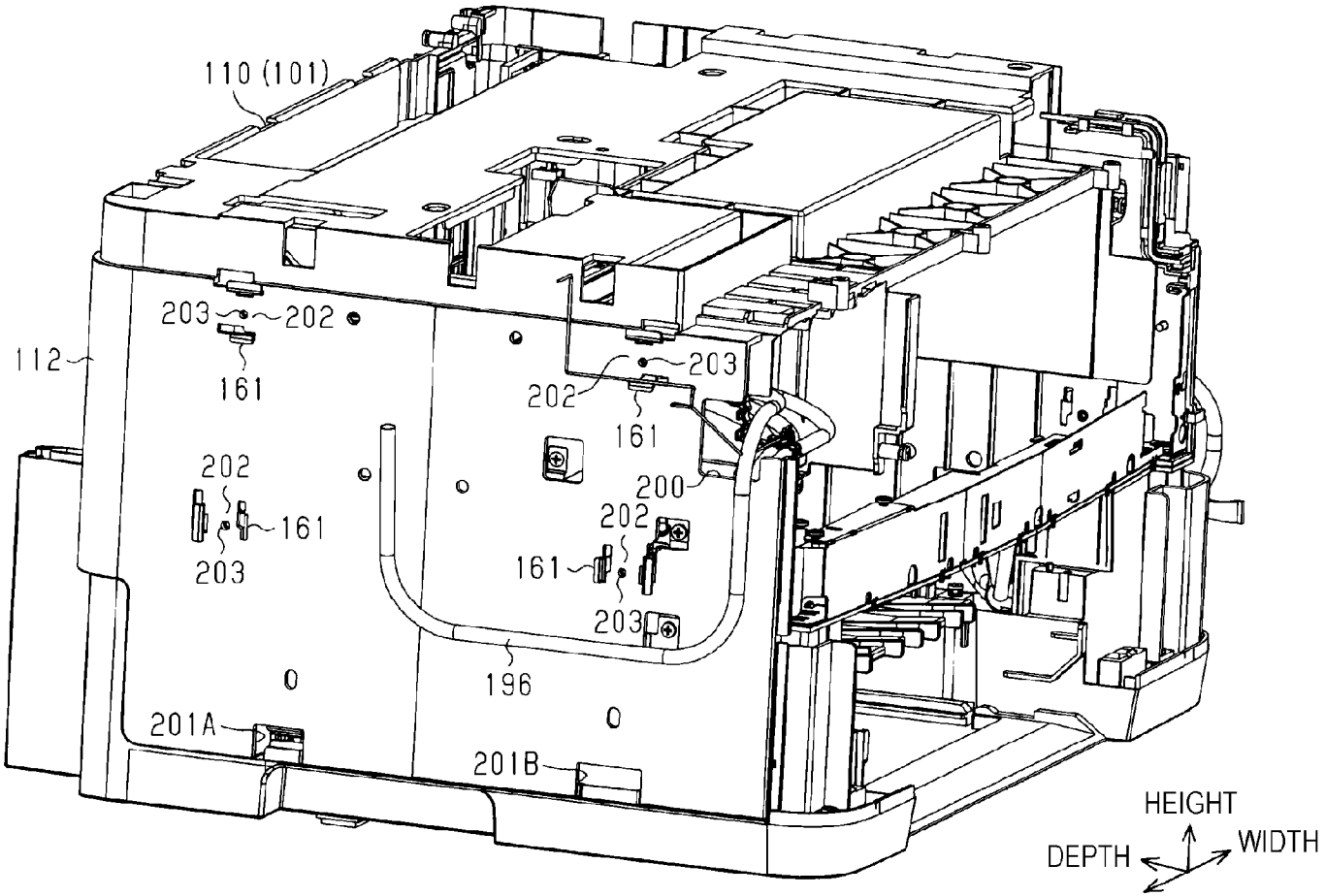
FIG. 18 is a perspective view of the housing middle.

As shown in FIG. 18, a recessed portion 200 notched from the front side in the depth direction of the printer is provided in the left sidewall 112 of the housing middle 110. The recessed portion 200 is provided at a position facing the tube inserting hole 198 provided in the case 191 of the second liquid containing unit 190. Therefore, the ink supply tube 196 and the individual cable laid around to the outside of the case 191 through the tube inserting hole 198 are guided to the inside of the housing 101 through the recessed portion 200 provided in the left sidewall 112 of the housing middle 110.

In addition, two cutout portions 201A and 201B are provided to be notched from the lower end of the left sidewall 112.

Similar to the right sidewall 111, the left sidewall 112 of the housing middle 110 is also formed to have a slightly curved shape in the depth direction of the printer such that the length of the printer is shortened in the width direction thereof as the left sidewall is closer to the front side and is closer to the rear side deep in the printer, that is, such that the central portion projects outward in the width direction of the printer. In addition, the left sidewall 112 is formed to have a slightly inclined shape with respect to the height direction of the printer such that the left sidewall is positioned further on the outer side as the left sidewall is closer to the lower side in the height direction of the printer, that is, such that the length of the printer is increased in the width direction thereof.

An attachment hole 202 having the same shape as the attachment hole 116 provided in the right sidewall 111 is formed in the left sidewall 112 having such a shape. Note that the attachment holes 202 are formed at total four positions with two positions on the upper side and two positions on the lower side. Note that, similarly, screw inserting holes 203 having a substantially circular shape are provided. The inner sheet metal 161 is press-fitted into the attachment hole 202 in the same method as the method described above. Therefore, in the state in which the inner sheet metal 161 press-fitted into the attachment hole 202, the screw hole 162 provided in the inner sheet metal 161 and the screw inserting hole 203 provided in the left sidewall 112 are overlapped with each other, and thus the elongated hole 166 of the inner sheet metal 161 and the inner hole portion 121 of the attachment hole 202 are overlapped with each other.

FIG. 18 shows a state after pieces of the inner sheet metal 161 are attached to all of the attachment holes 202 of the left sidewall 112. As shown in FIG. 18, the two attachment holes 202 provided on the upper side are provided to have an orientation different from that of the attachment holes 202 provided on the upper side. Therefore, the pieces of inner sheet metal 161, which are press-fitted into the attachment holes 202 on the upper side, of the pieces of inner sheet metal 161 attached to the left sidewall 112, have the elongated hole 166 extending in an orientation different from that in the pieces of other inner sheet metal 161. More specifically, the elongated hole 166 of the inner sheet metal 161, which is press-fitted into the attachment hole 202 on the upper side, extends in the rightward-leftward direction (depth direction of the housing 101) in FIG. 18, and the elongated hole 166 of the inner sheet metal 161, which is press-fitted into the attachment hole 202 on the lower side, extends in the vertical direction (height direction of the housing 101) in FIG. 18.

Figure 19:
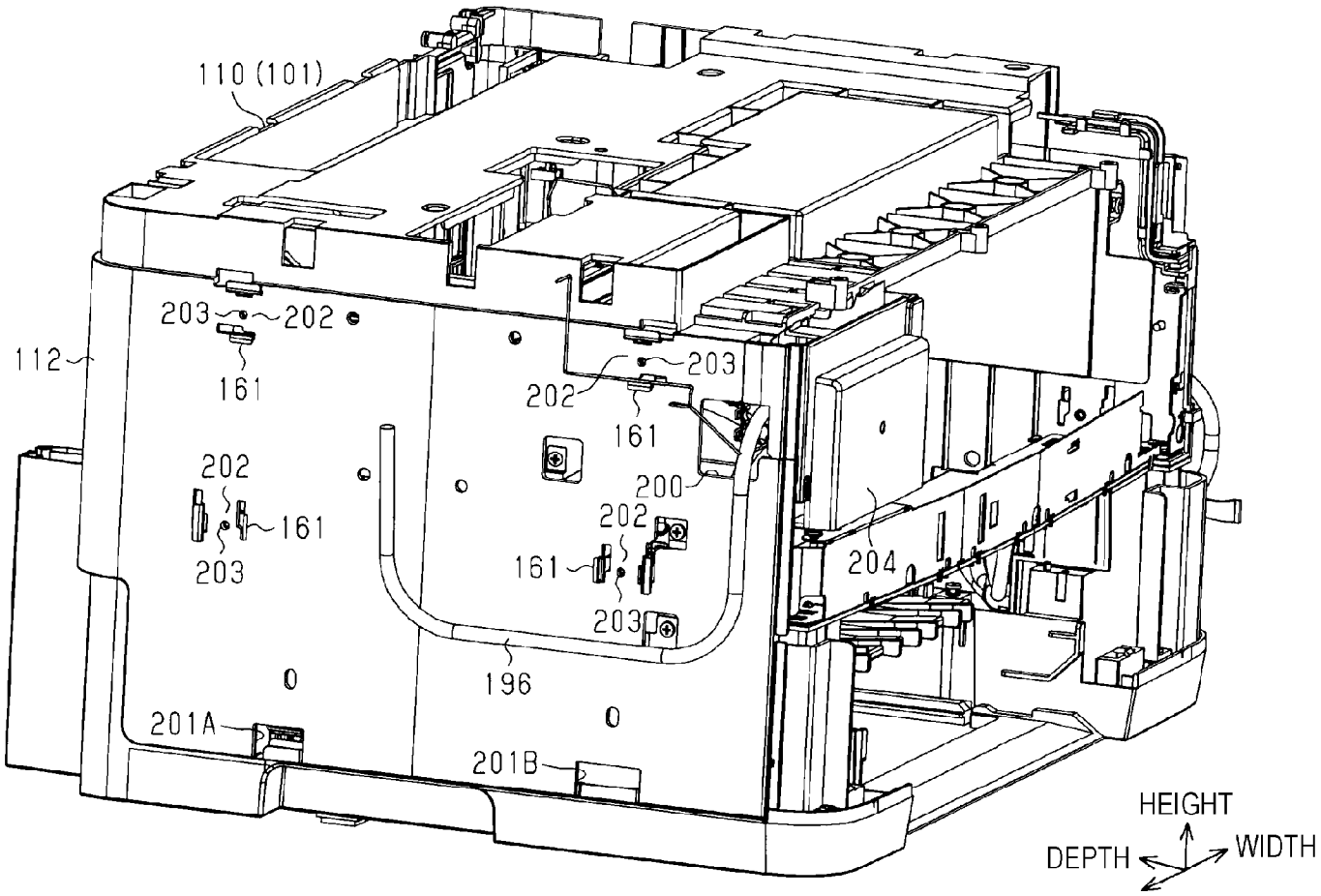
FIG. 19 is a perspective view of the housing middle to which a cover member is attached.

In addition, as shown in FIG. 19, a cover member 204, which covers a portion on the left-side surface side in the recording unit 100 in which the ink supply tube 196 is inserted, is attached to the housing middle 110, when the housing 101 is viewed from the front. The cover member 204 constitutes a part of the left-side surface of the housing 101, and the cover member 204 blocks an opening of the recessed portion 200 provided in the left sidewall 112 of the housing middle 110.

Next, a configuration of the outer sheet metal 199 of the second liquid containing unit 190, which is fastened to the inner sheet metal 161 that is press-fitted into the left sidewall 112, will be described with reference to FIG. 20.

Figure 20:
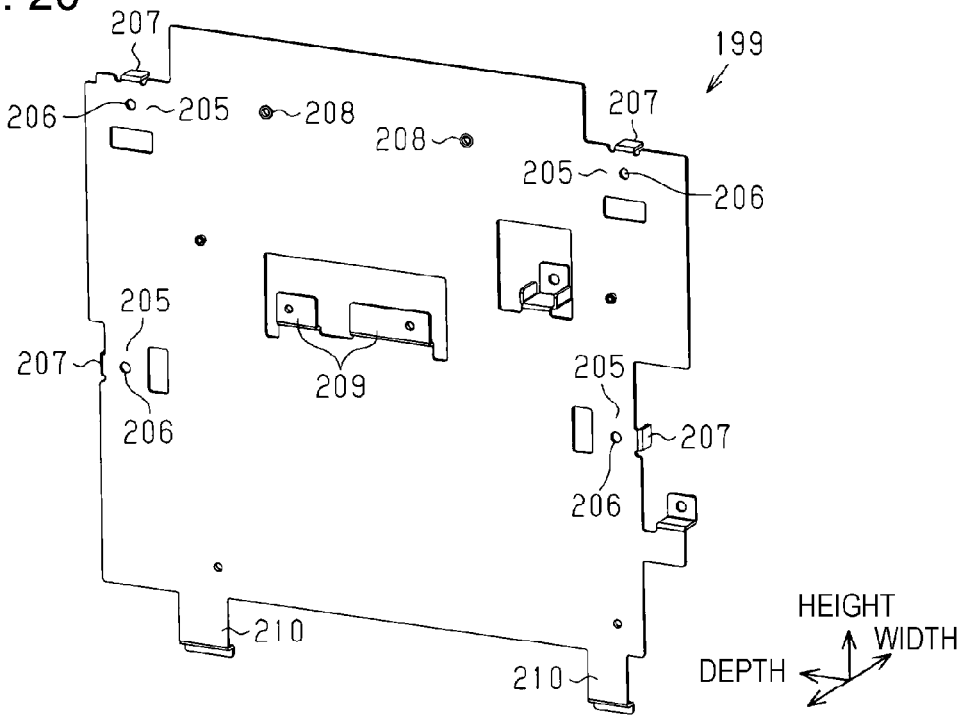
FIG. 20 is a perspective view of the outer sheet metal that is attached to the second liquid containing unit.

As shown in FIG. 20, the outer sheet metal 199 of the second liquid containing unit 190 does not have a step between a portion on the upper side and a portion on the lower side, unlike the outer sheet metal 160 of the first liquid containing unit 140. The outer sheet metal 199 has four fastening portions 205 at positions facing four pieces of inner sheet metal 161 provided in the left sidewall 112 of the housing middle 110. Circular screw holes 206 are provided in the fastening portions 205, respectively. In addition, projecting portions 207 are provided on the end portions of the fastening portions 205, respectively, and the projecting portion has a shape corresponding to the elongated hole 166 of the inner sheet metal 161 and projects inward in the width direction of the printer.

Two bosses 208 are provided in the upper end portion of the outer sheet metal 199 so as to be screwed with the screw penetrating through the case 191 when the stay 195 is fastened to the inner surface of the case 191 with the screw. In addition, two screwing portions 209 are provided at the central portion of the outer sheet metal 199 so as to be bent outward in the width direction of the printer. Meanwhile, two insertion portions 210 are provided in the lower end portion of the outer sheet metal 199 and are bent inward in the width direction of the printer so as to have front ends thereof extending downward.

Next, an example of a fastening method between the inner sheet metal 161 that is press-fitted into the left sidewall 112 of the housing middle 110 and the outer sheet metal 199 of the second liquid containing unit 190 will be described with reference to FIG. 21.

Figure 21:
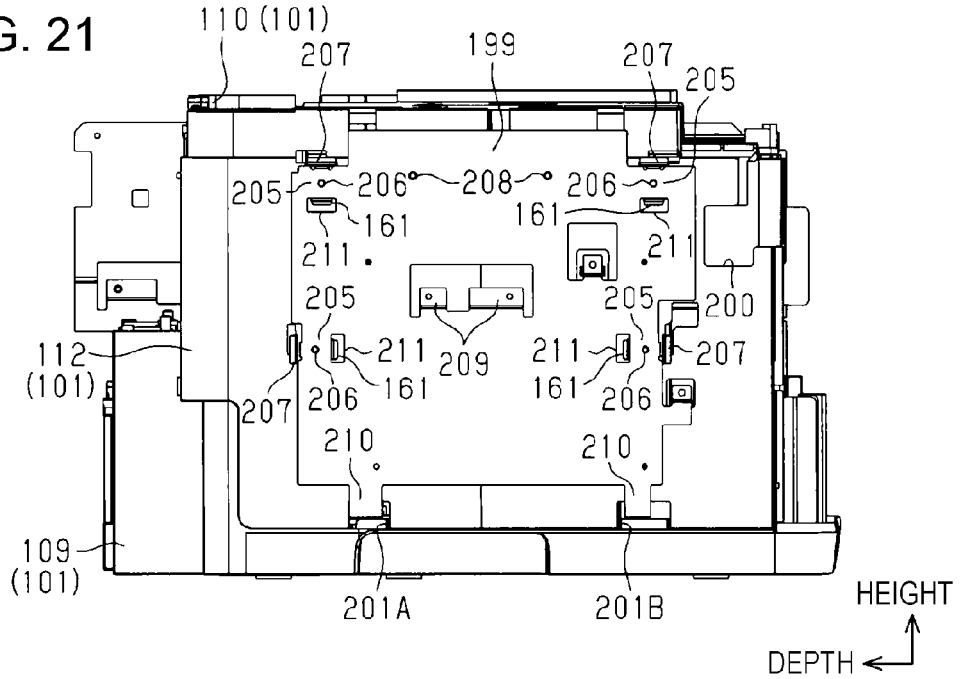
FIG. 21 is a left side view of the housing middle showing a state in which the inner sheet metal and the outer sheet metal are fastened to each other.

As shown in FIG. 21, with the lower end of the housing middle 110 supported by the base frame 109, first, the two insertion portions 210 provided on the lower end of the outer sheet metal 199 are inserted into the cutout portions 201A and 201B, respectively, provided on the lower end of the left sidewall 112 of the housing middle 110. In this manner, the lower end of the outer sheet metal 199 is supported by the housing 101 from below. Then, the projecting portions 207 provided in the fastening portions 205 of the outer sheet metal 199 are inserted into the elongated holes 166 of the pieces of inner sheet metal 161. Since the inner hole portion 121 provided in the attachment hole 202 of the left sidewall 112 is overlapped with the elongated hole 166 of the inner sheet metal 161, the projecting portion 207 inserted into the elongated hole 166 is also inserted into the inner hole portion 121 and penetrates through the left sidewall 112 of the housing middle 110.

In addition, a direction, in which the elongated hole 166 of the inner sheet metal 161 press-fitted into the attachment hole 202 on the upper side of the left sidewall 112 extends, is different from a direction in which the elongated hole 166 of the inner sheet metal 161 press-fitted into the attachment hole 202 on the lower side thereof extends. Therefore, the projecting portion 207 is inserted into the elongated hole 166, thereby making it possible to position the outer sheet metal 199 with respect to the left sidewall 112 and the inner sheet metal 161 in both the height direction and the depth direction of the printer. Then, screws are inserted, from the outer sheet metal 199 side, into the screw holes 206 of the fastening portions 205, into the screw inserting holes 203 of the housing middle 110, and into the screw holes 162 of the inner sheet metal 161 such that the inner sheet metal 161 and the outer sheet metal 199 are fastened to each other. When the inner sheet metal 161 and the outer sheet metal 199 are fastened to each other, the left sidewall 112 of the housing middle 110 enters a state of being interposed between the outer sheet metal 199 and the inner sheet metal 161.

In addition, the front end of the inner sheet metal 161 projects outward from the wall surface of the left sidewall 112. A plurality of hole portions 211 are provided in a portion of the outer sheet metal 199 which is overlapped with the front end of the inner sheet metal 161. Therefore, in the state in which the outer sheet metal 199 and the inner sheet metal 161 are fastened to each other, the front end of the inner sheet metal 161 is exposed through the hole portion 211 of the outer sheet metal 199.

In addition, in the state in which the inner sheet metal 161 and the outer sheet metal 199 are fastened to each other, the outer sheet metal 199 does not reach the recessed portion 200 of the left sidewall 112. Hence, the recessed portion 200 is not covered with the outer sheet metal 199, and the outer sheet metal 199 is not an obstacle when the ink supply tube 196 or the individual cable is guided into the inside of the housing 101.

As shown in FIG. 17, the case 191 of the second liquid containing unit 190 is fastened to the outer sheet metal 199 with a plurality of screws inserted from the inner side of the case 191. In addition, the stay 195 is fixed to the inner surface of the case 191. The screw 220, with which the upper end of the stay 195 is fixed to the case 191, penetrates through the case 191 and is screwed into the boss 208 provided in the outer sheet metal 199. Therefore, the screw 220, with which the upper end portion of the stay 195 is fixed to the case 191, not only fixes the case 191 and the stay 195 to each other, but also the case 191 and the outer sheet metal 199 to each other.

In addition, a hole is provided in a portion of the case 191 facing the lower end portion of the stay 195, and thus the screwing portion 209 of the outer sheet metal 199 is exposed through the portion. The lower end portion of the stay 195 is fastened to the screwing portion 209 with a screw.

In addition, a cutout hole 212 is formed in a portion of the side-wall forming member 193 of the case 191 which is not overlapped with the stay 195. The outer sheet metal 199 and the inner sheet metal 161 are disposed such that the screw holes 206 and 162 formed therein, respectively, are overlapped with the cutout hole 212, and the outer sheet metal 199 and the inner sheet metal 161 are fastened to each other with a screw 221 inserted into the screw holes 206 and 162 from the outer sheet metal 199 side. Therefore, the head of the screw 221, with which the case 191 and the housing 101 are fastened to each other, enters a state of being exposed though the cutout hole 212 provided in the case 191.

In the second liquid containing unit 190 having this configuration, it is possible to tighten or release, from the inside of the case 191, the screw 221, with which the outer sheet metal 199 and the inner sheet metal 161 are fastened to each other, without detaching the stay 195 attached to the case 191. Therefore, only with the release of the outer sheet metal 199 and the inner sheet metal 161 from the fastening, it is possible to detach the case 191 from the housing 101, with the outer sheet metal 199 fixed to the outer surface of the case 191. Thus, workability is improved when maintenance or the like of the recording unit 100 is performed.

Figure 22:
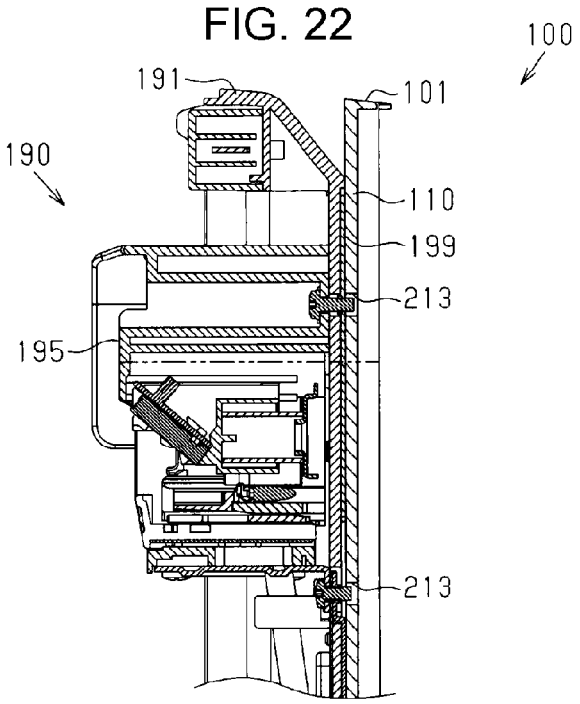
FIG. 22 is a sectional view taken along line 22-22 in FIG. 17.

In addition, as shown in FIG. 22, the outer surface of the case 191 of the second liquid containing unit 190 abuts on substantially the entirety of the surface of the outer sheet metal 199, and the housing 101 also abuts on substantially the entirety of the surface of the outer sheet metal 199. Therefore, an interference preventative hole 213 is provided in the wall surface of the housing middle 110. When the case 191 and the outer sheet metal 199 are fastened to each other with the screw inserted from the inner side of the case 191, the screw penetrating the outer sheet metal 199 does not interfere with the wall surface of the housing middle 110.

In addition, the left sidewall 112 of the housing middle 110 is inclined with respect to the height direction of the printer so as to be positioned further on the outer side as the left sidewall is closer to the lower side with respect to the height direction of the printer. Therefore, the second liquid containing unit 190 mounted along the left sidewall 112 is mounted on the housing 101 in a state of being inclined by the same angle as an inclination angle of the left sidewall 112 with respect to the height direction of the printer.

Figure 23:
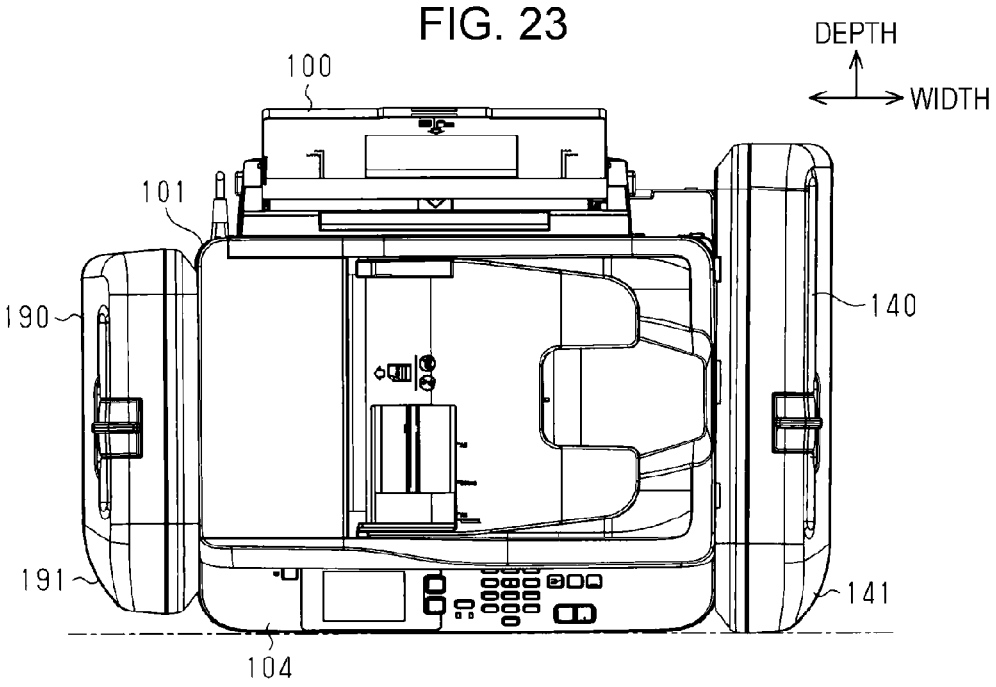
FIG. 23 is a top view of the recording apparatus.

Incidentally, as shown in FIG. 23, the length of the second liquid containing unit 190 is shorter in the depth direction of the printer than that of the first liquid containing unit 140. In the embodiment, the case 191 of the second liquid containing unit 190 is mounted to the left-side surface of the housing 101 without being inclined with respect to the height direction of the printer.

In addition, as shown in FIG. 23, the first liquid containing unit 140 and the second liquid containing unit 190 are positioned on the rear side deeper from a portion of the housing 101 on the frontmost side in the depth direction of the printer. Therefore, the cases 141 and 191 do not stick out from the housing 101 on the front side, and thus the cases 141 and 191 are unlikely to be considered an obstacle.

Figure 24:
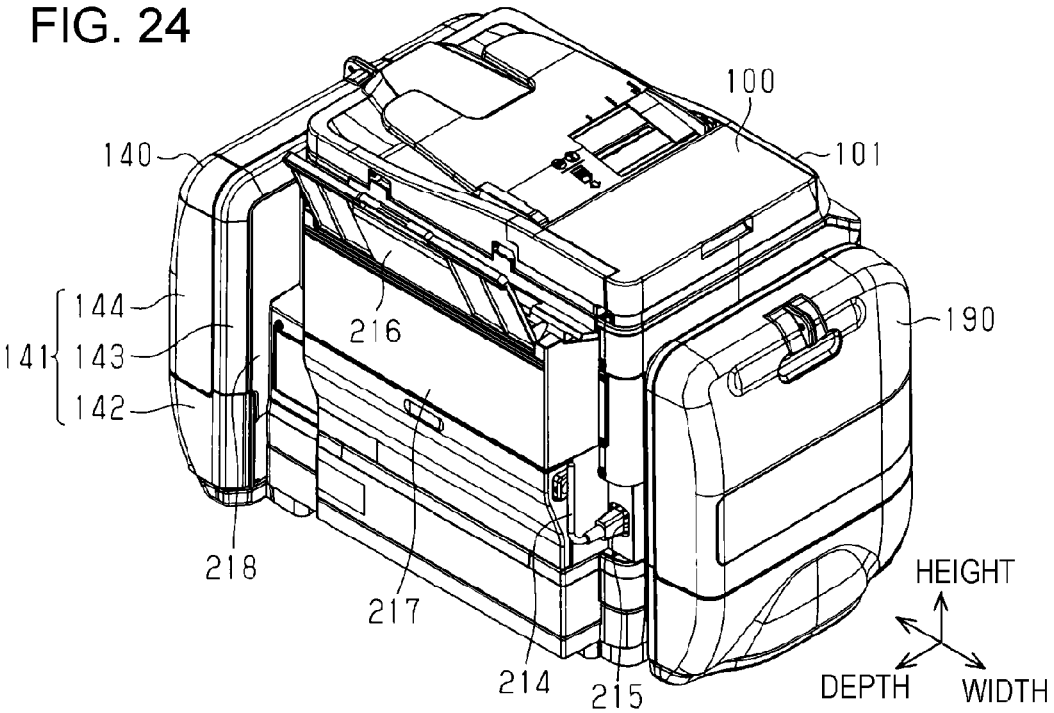
FIG. 24 is a perspective view of the recording apparatus showing a rear surface of the recording apparatus.
Figure 25:
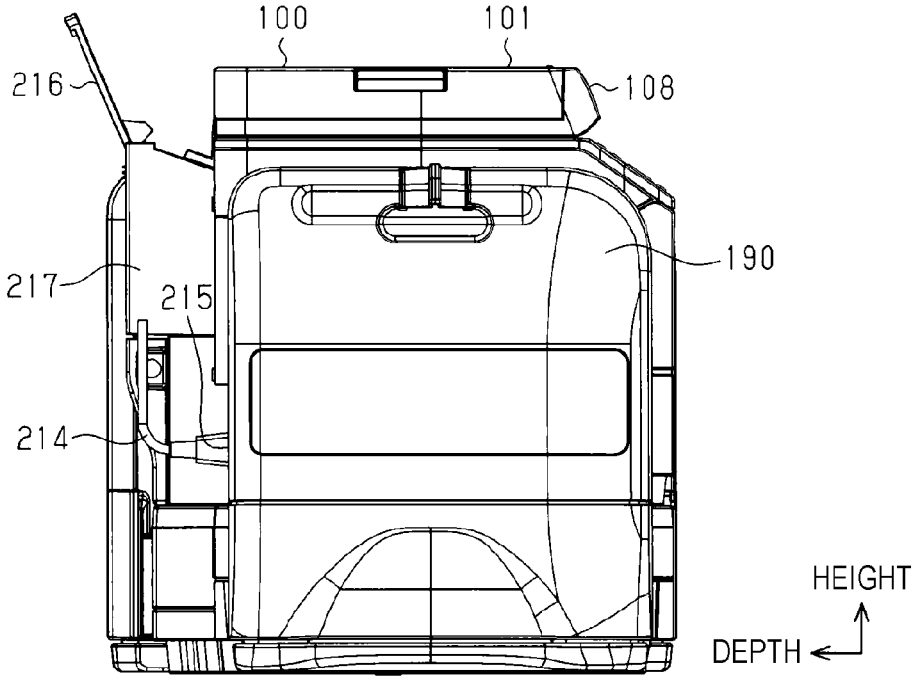
FIG. 25 is a left side view of the recording apparatus.

As shown in FIGS. 24 and 25, a plug port 215, to which a power cord 214 is connected, is provided on the end portion of a rear surface of the housing 101 of the printer on the left-side surface side. In addition, a mounting tray 216 in which the sheet P is mounted, a sheet feed portion 217 that feeds, to the inside of the housing 101, the sheet P mounted in the mounting tray 216, or the like, is provided on the rear surface of the housing 101. The mounting tray 216 or the sheet feed portion 217 projects further than the plug port 215 toward the rear side deep in the depth direction of the printer. Therefore, in a case where the second liquid containing unit 190 mounted on the left-side surface projects further to the rear side than the plug port 215 of the housing 101, both side portions of the plug port 215 enter a state of being blocked. Therefore, there is a concern that it will be difficult to plug or pull out the power cord 214 into or from the plug port 215. In the embodiment, the second liquid containing unit 190 is mounted on the left-side surface of the housing 101 such that the second liquid containing unit 190 is not positioned on the rear side further than the plug port 215 in the depth direction of the printer. Therefore, a user has an easy access to the plug port 215 such that the power cord 214 is easily plugged or pulled out.

Figure 26:
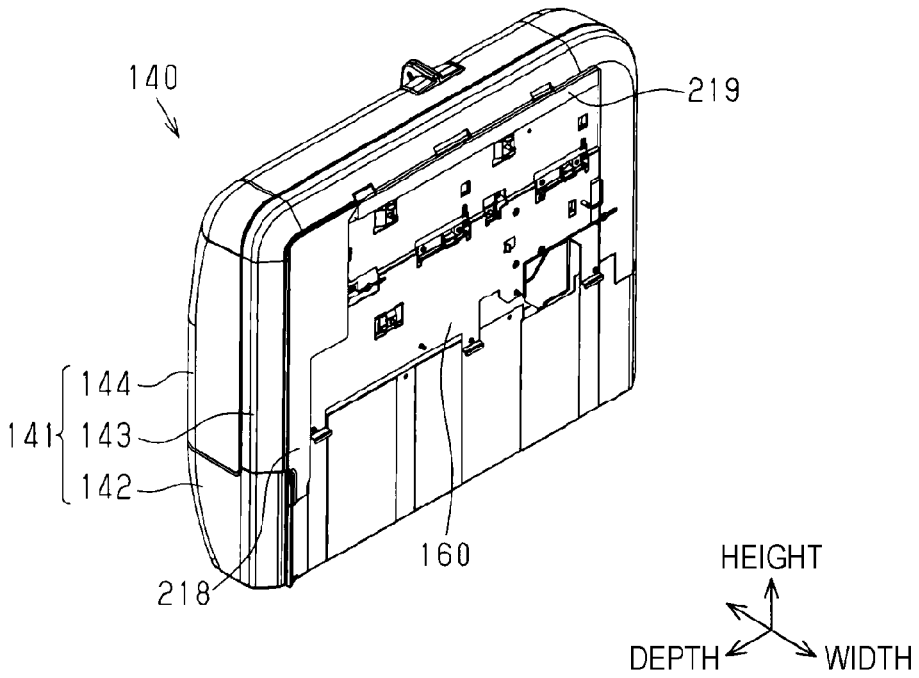
FIG. 26 is a perspective view of the first liquid containing unit to which the outer sheet metal is attached.

In addition, as shown in FIGS. 24 and 26, the case 141 of the first liquid containing unit 140 is mounted on the housing 101 in a state of sticking out to the rear side in the depth direction of the printer. Therefore, a decorative sheet 218 covering a portion sticking out to the rear side is attached to the outer surface of the case 141. In addition, as shown in FIG. 26, sponge 219 as an example of a sealing member is attached to the upper end of the outer sheet metal 160. Therefore, when the first liquid containing unit 140 is attached to the housing 101, the sponge 219 enters a state of being interposed between the case 141 and the housing 101. In this manner, the gap between the housing 101 and the case 141 is blocked.

According to the first embodiment described above, the following operational effects are obtained.

(1) The pieces of inner sheet metal 161 are attached to the inner surfaces of the housing 101, and the pieces of outer sheet metal 160 and 199 are attached to the outer surface of the case 141 of the first liquid containing unit 140 and to the outer surface of the case 191 of the second liquid containing unit 190, respectively. Then, the pieces of inner sheet metal 161 and the pieces of outer sheet metal 160 and 199 are fastened to each other, and thereby the housing 101 and the cases 141 and 191 are fixed. Therefore, compared to the case where the housing 101 and the cases 141 and 191 are directly fastened to each other, the strength of the portions, in which the housing 101 and the cases 141 and 191 are fixed, is increased to the extent that the sheet metal is reinforced. In addition, since the housing 101 and the cases 141 and 191 are fastened to each other with the screws via the pieces of inner sheet metal 161 and the pieces of outer sheet metal 160 and 199, a load transmitted via the screws is distributed to a broad range of the housing 101 and the cases 141 and 191 via the sheet metal, compared to the case where the housing 101 and the cases 141 and 191 are directly fastened to each other. Hence, it is possible to realize the printer in which the cases 141 and 191, in which the liquid container is accommodated, are reliably fixed to the housing 101 with sufficient strength.

(2) Since the inner sheet metal 161 is press-fitted into the attachment holes 116 and 202 provided in the wall surface of the housing 101 made of a resin, it is possible to easily perform assemble the inner sheet metal 161 to the housing 101.

(3) The inner sheet metal 161 is attached to the housing 101 such that the direction, in which the elongated hole 166 of the inner sheet metal 161 press-fitted into the attachment hole 116 on the upper side of the right-side surface of the housing 101 extends, is different from the direction, in which the longitudinal hole 126 provided between the attachment holes 116 on the lower side extends. The projecting portions 175 of the outer sheet metal 160 are inserted into the elongated holes 166 of the pieces of inner sheet metal 161, respectively, and the projecting portion 174 of the outer sheet metal 160 is inserted into the longitudinal hole 126. Therefore, it is possible to perform positioning in at least two directions such that it is possible to reduce the positional shift of the case 141 and the housing 101, and to perform positioning with higher accuracy.

(4) The inner sheet metal 161 press-fitted into the attachment hole 202 on the upper side of the left-side surface of the housing 101 is attached such that the directions, in which the elongated holes 166 of the pieces of inner sheet metal 161 press-fitted into the attachment holes 202 on the lower side extend, are different from each other, and the projecting portions 207 of the outer sheet metal 199 are inserted into the elongated holes 166, respectively. Therefore, it is possible to perform positioning in at least two directions such that it is possible to reduce the positional shift of the case 191 and the housing 101, and to perform positioning with higher accuracy.

(5) The cutout hole 129 is formed in the portion of the case 141 of the first liquid containing unit 140 which is not overlapped with the stays 153 attached to the inner surface of the case 141, and the outer sheet metal 160 and the inner sheet metal 161 are disposed such that the screw holes 162 and 172 formed therein, respectively, are overlapped with the cutout hole 129. The inner sheet metal 161 and the outer sheet metal 160 are fastened to each other with the screw 131 inserted into the screw holes 162 and 172 from the outer sheet metal 160 side. Therefore, the head of the screw 131, with which the case 141 and the housing 101 are fastened to each other, enters a state of being exposed though the cutout hole 129 provided in the case 141. In this manner, it is possible to tighten or release the screw 131 from the inside of the case 141 even when the stay 153 attached to the case 141 is not removed. Therefore, it is possible to easily fasten or remove the inner sheet metal 161 and the outer sheet metal 160.

(6) The insertion portion 178 is provided on the lower end of the outer sheet metal 160 and the insertion portion 178 is inserted to the housing 101 from above. Therefore, the lower end of the outer sheet metal 160 attached to the case 141 is supported by the housing 101 from below. Hence, it is possible to more reliably fix, to the housing 101, the heavy case 141 in which the liquid container 150 is accommodated.

(7) The cutout hole 212 is formed in the portion of the case 191 of the second liquid containing unit 190 which is not overlapped with the stay 195 attached to the inner surface of the case 191, and the inner sheet metal 161 and the outer sheet metal 199 are disposed such that the screw holes 162 and 206 formed therein, respectively, are overlapped with the cutout hole 212. The inner sheet metal 161 and the outer sheet metal 199 are fastened to each other with the screw 220 inserted into the screw holes 162 and 206 from the outer sheet metal 199 side. Therefore, the head of the screw 220, with which the case 191 and the housing 101 are fastened to each other, enters a state of being exposed though the cutout hole 212 provided in the case 191. In this manner, it is possible to tighten or release the screw 220 from the inside of the case 191 even when the stay 195 attached to the case 191 is not removed. Therefore, it is possible to easily fasten or remove the inner sheet metal 161 and the outer sheet metal 199.

(8) The insertion portion 210 is provided on the lower end of the outer sheet metal 199 and the insertion portion 210 is inserted to the housing 101 from above. Therefore, the lower end of the outer sheet metal 199 attached to the case 191 is supported by the housing 101 from below. Hence, it is possible to more reliably fix, to the housing 101, the heavy case 191 in which the liquid container is accommodated.

(9) The upper sheet portion 167 of the outer sheet metal 160 is positioned to the outer side with respect to the lower sheet portion 168 in the width direction of the printer, the outer sheet metal 160 that is attached to the outer surface of the case 141, and the scanner portion 108 provided above the housing 101 face each other, and the gap is provided between the outer sheet metal and the scanner portion. Therefore, it is difficult for the front end of the screw to interfere with the wall surface of the scanner portion 108 even when the case 141 and the outer sheet metal 160 are fastened to each other with the screw. Hence, there is no need to provide the interference preventative hole in the wall surface of the scanner portion 108, which prevents the interference of the screw with the wall surface, and it is possible to prevent grit from entering the inside of the scanner portion 108.

Second Embodiment

Next, the second embodiment, in which the recording apparatus is embodied in an ink jet type printer (hereinafter, simply referred to as a "printer"), will be described with reference to FIGS. 27 to 35. Note that, in the second embodiment, the size of the recording unit is increased more than that in the first embodiment such that it is possible to perform the recording on a larger sheet P than the sheet used in the printer of the first embodiment. In the embodiment, a part different from that in the first embodiment is mainly described, the same reference signs are assigned to the same configuration as that in the first embodiment, and detailed description thereof is omitted.

In the printer of the embodiment, similar to the printer of the first embodiment described, the first liquid containing unit 140 is attached to the right-side surface of the housing 101 of the recording unit 100, and the second liquid containing unit 190 is attached to the left-side surface of the housing 101. Note that the housing 101 of the recording unit 100 is configured to include the base frame 109 as a base of the printer, and a housing middle 300 that is attached on the base frame 109 so as to be supported on the base frame 109.

Figure 27:
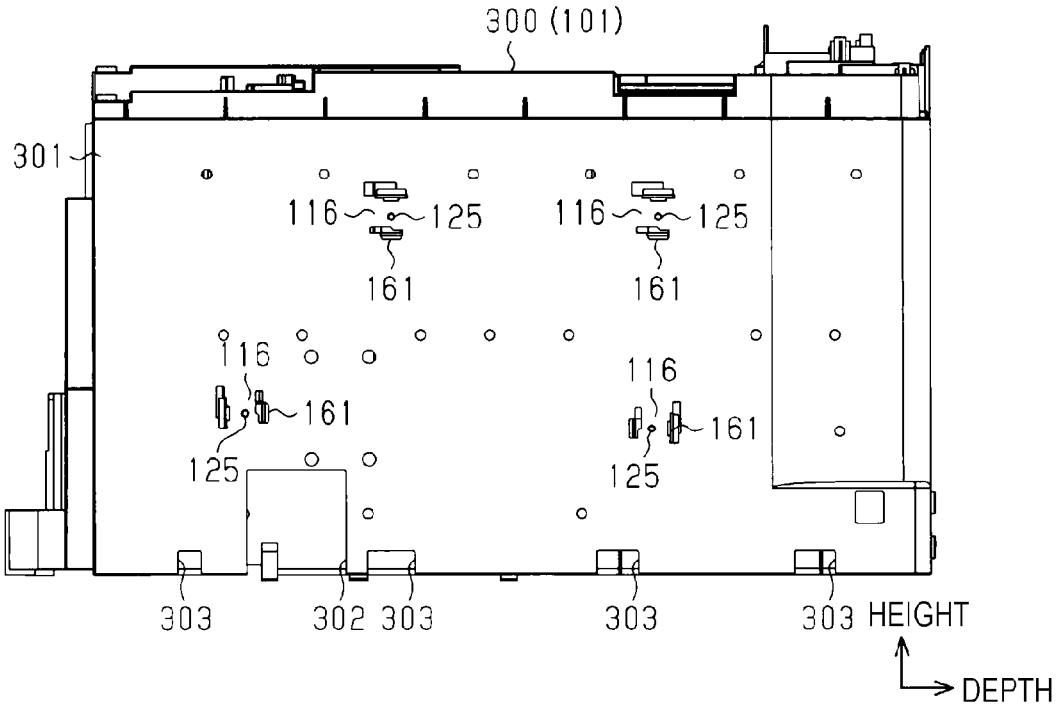
FIG. 27 is a right side view of a housing middle of a recording apparatus of a second embodiment.

As shown in FIG. 27, a recessed portion 302 notched from a lower end of a right sidewall 301 is provided in the right sidewall of the housing middle 300 to which the first liquid containing unit 140 is mounted. The recessed portion 302 is provided at a position facing the tube inserting hole 156 provided in the case of the first liquid containing unit 140. Therefore, the ink supply tubes 154 and the integrated cable 159 laid around to the outside of the case 141 through the tube inserting hole 156 are guided to the inside of the housing 101 through the recessed portion 302 of the housing middle 300. In addition, four cutout portions 303 are formed on the lower end of the right sidewall 301.

In addition, similar to the housing middle 110 in the printer of the first embodiment, the right sidewall 301 of the housing middle 300 is formed to have a slightly inclined shape with respect to the height direction of the printer such that the right sidewall is positioned further to the outer side as the right sidewall is closer to the lower end in the height direction of the printer, that is, such that the length of the printer is increased in the width direction thereof as the right sidewall is closer to the lower side in the height direction of the printer. However, unlike the housing middle 110, in the housing middle 300, the right sidewall 301 is not curved in the depth direction of the printer.

The attachment hole 116 is formed in the right sidewall 301 having such a shape. The inner sheet metal 161 is press-fitted into the attachment hole 116. Note that the attachment holes 116 are formed at total four positions with two positions on the upper side and two positions on the lower side.

The two attachment holes 116 provided on the upper side are provided to have an orientation different from that of the attachment holes 116 provided on the upper side. Therefore, of the pieces of inner sheet metal 161 attached to the right sidewall 301, the pieces of inner sheet metal 161, which are press-fitted into the attachment holes 116 on the upper side, have the elongated hole 166 extending in an orientation different from that in the pieces of other inner sheet metal 161 which are press-fitted into the attachment holes 116 on the lower side. More specifically, the elongated hole 166 of the inner sheet metal 161, which is press-fitted into the attachment hole 116 on the upper side, extends in the rightward-leftward direction (depth direction of the housing 101) in FIG. 27 and the elongated hole 166 of the inner sheet metal 161, which is press-fitted into the attachment hole 116 on the lower side, extends in the vertical direction (height direction of the housing 101) in FIG. 27.

Next, a configuration of the outer sheet metal 304 of the first liquid containing unit 140, which is fastened to the inner sheet metal 161 that is press-fitted into the right sidewall 301, will be described with reference to FIG. 28.

Figure 28:
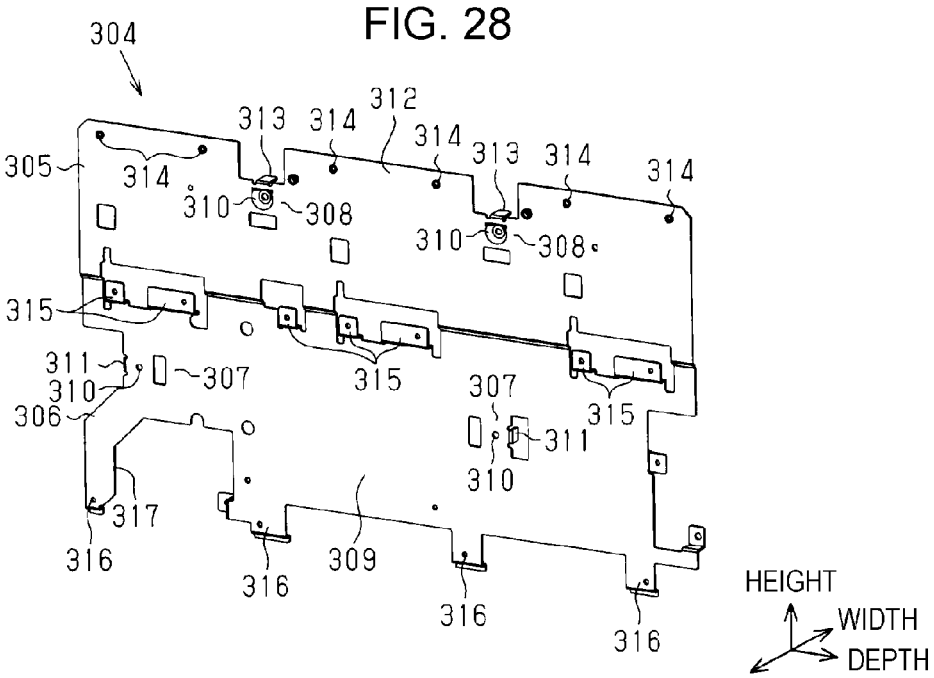
FIG. 28 is a perspective view of outer sheet metal that is attached to a first liquid containing unit of the recording apparatus of the second embodiment.

As shown in FIG. 28, the outer sheet metal 304 has an upper sheet portion 305 positioned on the upper side of the printer in the height direction, and a lower sheet portion 306 positioned on the lower side. The upper sheet portion 305 is connected to the lower sheet portion 306 and the upper sheet portion 305 is positioned on the outer side with respect to the lower sheet portion 306 in the width direction of the printer. A lower side fastening portion 307 is provided at two positions in the lower sheet portion 306 so as to be fastened, with a screw, to the inner sheet metal 161 provided on the lower side of the right sidewall 301 of the housing middle 300. In addition, upper side fastening portions 308 are provided at two positions in the upper sheet portion 305 so as to be fastened, with a screw, to the inner sheet metal 161 provided on the upper side of the right sidewall 301 of the housing middle 300.

The lower side fastening portion 307 has a circular screw hole 310 provided in a reference surface 309 of the lower sheet portion 306. In addition, projecting portions 311 are provided on the end portions of the lower side fastening portion 307, respectively, have a shape corresponding to the elongated hole 166 of the inner sheet metal 161 provided on the lower side of the right sidewall 301 of the housing middle 300 so as to extend in the height direction of the printer, and project inward in the width direction of the printer.

Meanwhile, the screw hole 310 in the upper side fastening portion 308 provided in the upper sheet portion 305 projects inward from the reference surface 312 of the upper sheet portion 305 in the width direction of the printer. Note that a degree of the projecting is the same as a size of the step between the reference surface 309 of the lower sheet portion 306 and the reference surface 312 of the upper sheet portion 305. In addition, in the depth direction of the printer, a degree of projecting of the upper side fastening portion 308 on the front side is the same as a degree of projecting of the upper side fastening portion 308 on the rear side. Therefore, positions of the screw hole 310 provided in the upper side fastening portion 308 and the screw hole 310 of the lower side fastening portion 307 are aligned in the thickness direction of the outer sheet metal 160, which is a direction perpendicular to the reference surface 309 and the reference surface 312. In addition, a projecting portion 313 is provided on the upper side fastening portion 308, has a shape corresponding to the elongated hole 166 of the inner sheet metal 161 on the upper end of the upper side fastening portion so as to extend in the depth direction of the printer, and projects inward in the width direction of the printer.

In addition, a plurality of bosses 314 are provided in the upper end portion of the outer sheet metal 304 so as to be screwed with screws penetrating through the case 141 when the stays 153 are fastened to the inner surface of the case 141 with the screws. In addition, a plurality of screwing portions 315 are provided in the upper end portion of the lower sheet portion 306 of the outer sheet metal 304 so as to be bent outward in the width direction of the printer. Meanwhile, four insertion portions 316 are provided in the lower end portion of the lower sheet portion 306 and are bent inward from the reference surface 309 of the lower sheet portion 306 in the width direction of the printer so as to have front ends thereof extending downward. A notch 317 is formed in a portion on the front side in the depth direction of the printer.

Next, an example of a fastening method between the outer sheet metal 304 and the inner sheet metal 161 will be described with reference to FIG. 29.

Figure 29:
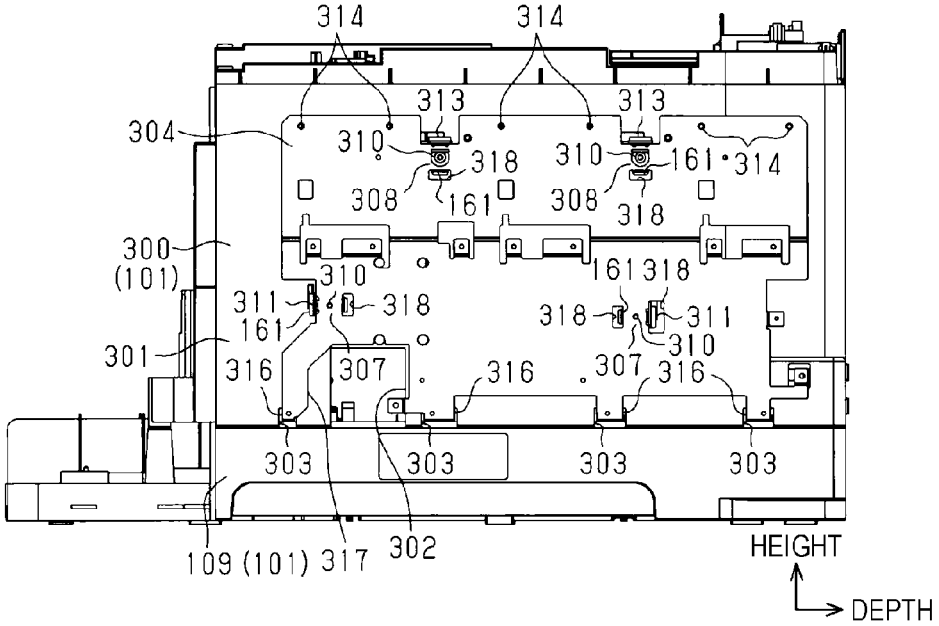
FIG. 29 is a right side view of the housing middle showing a state in which inner sheet metal and the outer sheet metal are fastened to each other in the recording apparatus of the second embodiment.

As shown in FIG. 29, with the lower end of the housing middle 300 supported by the base frame 109, first, the insertion portions 316 provided on the lower end of the outer sheet metal 304 are inserted into the cutout portions 303, respectively, provided on the lower end of the right sidewall 301 of the housing middle 300. In this manner, the lower end of the outer sheet metal 304 is supported by the housing 101 from below. Then, the projecting portions 311 and 313 provided in the fastening portions 307 and 308 are inserted into the elongated holes 166 of the two pieces of inner sheet metal 161. Since the inner hole portion 121 provided in the attachment hole 116 of the right sidewall 301 is overlapped with the elongated hole 166 of the inner sheet metal 161, the projecting portions 311 and 313 inserted into the elongated hole 166 are also inserted into the inner hole portion 121 and penetrates through the right sidewall 301 of the housing middle 110.

A direction, in which the elongated hole 166 of the inner sheet metal 161 press-fitted into the attachment hole 116 on the upper side of the right sidewall 301 extends, is different from a direction in which the elongated hole 166 of the inner sheet metal 161 press-fitted into the attachment hole 116 on the lower side thereof extends. Therefore, the projecting portions 311 and 313 of the outer sheet metal 304 are inserted into the elongated hole 166, thereby making it possible to position the outer sheet metal 304 with respect to the right sidewall 301 and the inner sheet metal 161 in both the height direction and the depth direction of the printer. Then, screws are inserted, from the outer sheet metal 304 side, into the screw holes 310 of the fastening portions, the screw inserting holes 125 of the housing middle 300 and into the screw holes 162 of the inner sheet metal 161 such that the inner sheet metal 161 and the outer sheet metal 304 are fastened to each other. When the inner sheet metal 161 and the outer sheet metal 304 are fastened to each other, the right sidewall 301 of the housing middle 300 enters a state of being interposed between the outer sheet metal 304 and the inner sheet metal 161.

In addition, the front end of the inner sheet metal 161 projects outward from the wall surface of the right sidewall 301. A plurality of hole portions 318 are provided in a portion of the outer sheet metal 304 which is overlapped with the front end of the inner sheet metal 161. Therefore, in the state in which the outer sheet metal 304 and the inner sheet metal 161 are fastened to each other, the front end of the inner sheet metal 161 is exposed through the hole portion 318 of the outer sheet metal 304.

In this state, the notch 317 provided on the lower end of the outer sheet metal 304 is overlapped with the recessed portion 302 of the right sidewall 301 of the housing middle 300, that is, the tube inserting hole 156 of the case 141. Therefore, when the outer sheet metal 304 and the inner sheet metal 161 are fastened to each other, it is possible to lead the ink supply tubes 154 or the integrated cable 159 into the inside of the housing 101 through the notch 317 and the tube inserting hole 156 without covering the tube inserting hole 156 with the outer sheet metal 304.

Figure 30:
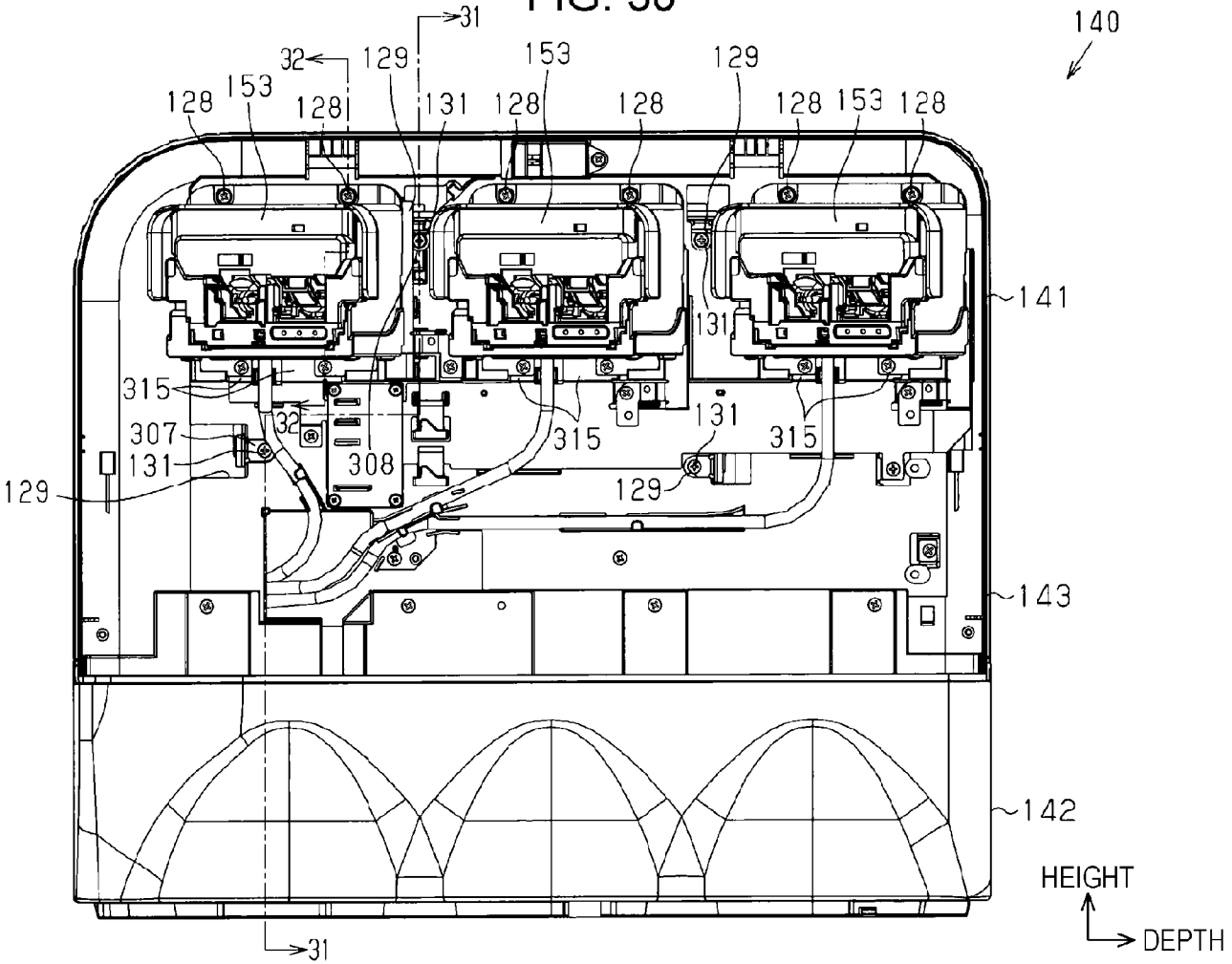
FIG. 30 is a front view of the first liquid containing unit of the recording apparatus of the second embodiment, with a lid and a cover removed.

As shown in FIG. 30, the case 141 of the first liquid containing unit 140 is fastened to the outer sheet metal 304 with a plurality of screws inserted from the inner side of the case 141. In addition, the plurality of stays 153 are fixed to the inner surface of the case 141. The screw 128, with which the upper end of the stay 153 is fixed to the case 141, penetrates through the case 141 and is screwed into the boss 314 provided in the outer sheet metal 304. Therefore, the screw 128, with which the upper end portion of the stay 153 is fixed to the case 141, not only fixes the case 141 and the stay 153 to each other, but also the case 141 and the outer sheet metal 304 to each other.

In addition, a hole is provided in a portion of the case 141 facing the lower end portion of the stay 153, and thus the screwing portion 315 of the outer sheet metal 304 is exposed through the portion. The lower end portion of the stay 153 is fastened to the screwing portion 315 with a screw.

In addition, the cutout hole 129 is formed in a portion of the side-wall forming member 143 of the case 141 which is not overlapped with the stays 153. The outer sheet metal 304 and the inner sheet metal 161 are disposed such that the screw holes 310 and 162 formed therein, respectively, are overlapped with the cutout hole 129, and the outer sheet metal 304 and the inner sheet metal 161 are fastened to each other with the screw 131 inserted into the screw holes 310 and 162 from the outer sheet metal 304 side. Therefore, the head of the screw 131, with which the case 141 and the housing 101 are fastened to each other, enters a state of being exposed though the cutout hole 129 provided in the case 141.

In the first liquid containing unit 140 having this configuration, it is possible to tighten or release, from the inside of the case 141, the screw 131, with which the outer sheet metal 304 and the inner sheet metal 161 are fastened to each other, without detaching the stay 153 attached to the case 141. Therefore, only with the release of the outer sheet metal 304 and the inner sheet metal 161 from the fastening, it is possible to detach the case 141 from the housing 101, with the outer sheet metal 304 fixed to the outer surface of the case 141.

Next, a structure of a cross section of a fixing portion of the housing 101 and the case 141 will be described with reference to FIG. 31. Note that FIG. 31 is a view schematically showing the structure of the cross section taken along a line connecting the upper side fastening portion 308 and the lower side fastening portion 307 in FIG. 30.

Figure 31:
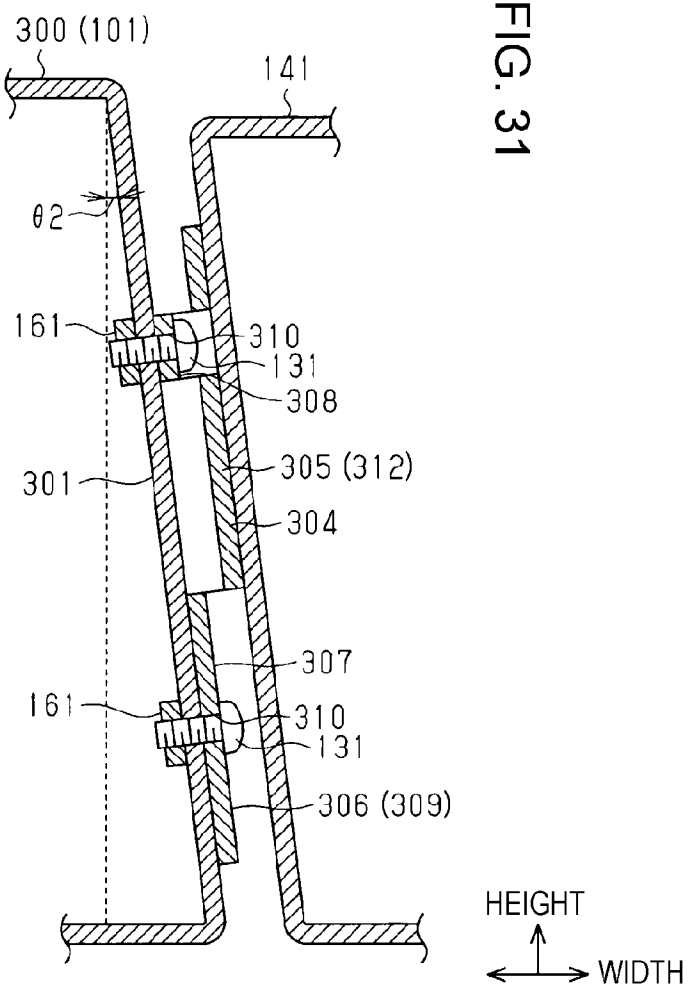
FIG. 31 is a view schematically showing a cross section taken along line 31-31 in FIG. 30.

As shown in FIG. 31, the right sidewall 301 of the housing middle 300 is inclined by an inclination angle θ2 with respect to the height direction of the printer so as to be positioned further on the outer side as the right sidewall is closer to the lower side with respect to the height direction of the printer. Also, the inner sheet metal 161 is attached to the right sidewall 301 from the inner side of the housing 101. In other words, the inner sheet metal 161 is attached to the inner surface of the housing middle 300.

In addition, since the lower side fastening portion 307 is provided in the reference surface 309 of the lower sheet portion 306 in the outer sheet metal 304, the lower sheet portion 306 of the outer sheet metal 304 abuts on the outer surface of the housing middle 300 and is fastened with the screw 131 in a state of being separated from the outer surface of the case 141. The upper sheet portion 305 connected to the lower sheet portion 306 is positioned on the outer side from the lower sheet portion 306 in the width direction of the printer. Therefore, the upper sheet portion 305 is separated from the outer surface of the housing middle 300 and abuts on the outer surface of the case 141. The upper side fastening portion 308 projects from the upper sheet portion 305 toward the housing middle 300 side, and is fastened to the inner sheet metal 161 with the screw 131 with the screw hole 310 abutting on the outer surface of the housing middle 300. As described above, a degree of the projecting of the upper side fastening portion 308 from the reference surface 312 is the same as the size of the step between the reference surface 312 and the reference surface 309 such that positions of the screw hole 310 provided in the upper side fastening portion 308 and the screw hole 310 provided in the lower side fastening portion 307 are aligned in the thickness direction of the outer sheet metal 304. Therefore, distances from the outer surface of the case 141 to the upper side fastening portion 308 and the lower side fastening portion 307 are the same as each other. Thus, the case 141 of the first liquid containing unit 140 is mounted on the housing 101 in a state of being inclined by the same angle as the inclination angle θ2 with respect to the height direction of the printer, so as to be positioned over the inclined right-side surface of the housing 101.

In addition, in the depth direction of the printer, the positions of the screw holes 310 in the upper side fastening portion 308 provided on the front side, and in the upper side fastening portion 308 on the rear side are aligned in the thickness direction of the outer sheet metal 304. In addition, in the depth direction of the printer, the positions of the screw holes 310 in the lower side fastening portion 307 provided on the front side, and in the lower side fastening portion 307 on the rear side are aligned in the thickness direction of the outer sheet metal 304. Therefore, the case 141 of the first liquid containing unit 140 is mounted to be matched with the right sidewall 301 of the housing 101 in the depth direction of the printer. Thus, unlike the first embodiment described above, the case 141 is mounted to the housing 101 without being inclined with respect to the housing 101 in the depth direction of the printer.

Figure 32:
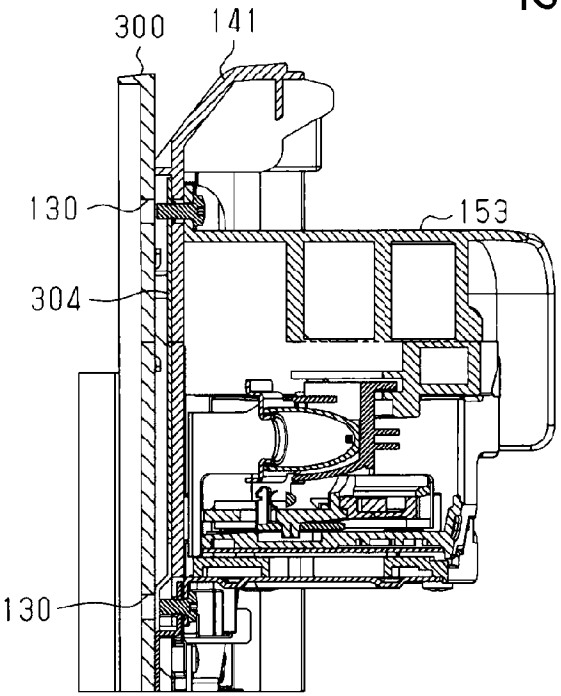
FIG. 32 is a sectional view taken along line 32-32 in FIG. 30.

In addition, as shown in FIG. 32, the interference preventative hole 130 is provided in a portion of the wall surface of the housing middle 300, which faces the screw with which the case 141 and the outer sheet metal 304 are fixed. In this manner, when the outer sheet metal 304 and the case 141 are fastened to each other with the screw from the inner side of the case 141, the screw penetrating through the outer sheet metal 304 does not interfere with the wall surface of the housing 101.

Next, the second liquid containing unit 190 which is attached to the left-side surface of the housing 101 will be described.

Figure 33:
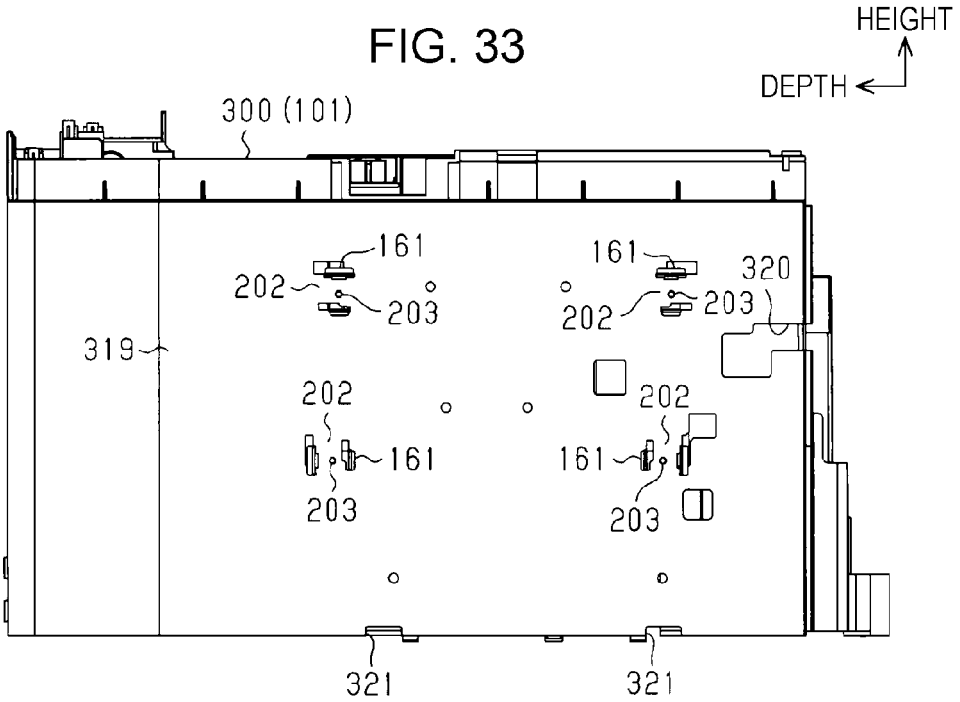
FIG. 33 is a left side view of the housing middle of the recording apparatus of the second embodiment.

As shown in FIG. 33, a recessed portion 320 notched from the front side in the depth direction of the printer is provided in the left sidewall 319 of the housing middle 300. The recessed portion 320 is provided at a position facing the tube inserting hole 198 provided in the case 191 of the second liquid containing unit 190. Therefore, the ink supply tube 196 and the individual cable laid around to the outside of the case 191 through the tube inserting hole 198 are guided to the inside of the housing 101 through the recessed portion 320 provided in the left sidewall 319 of the housing middle 300. In addition, two cutout portions 321 are formed to be notched from the lower end of the left sidewall 319.

Similar to housing middle 110 in the printer of the first embodiment, the left sidewall 319 of the housing middle 300 is formed to have a slightly inclined shape with respect to the height direction of the printer such that the right sidewall is positioned further to the outer side as the right sidewall is closer to the lower end in the height direction of the printer, that is, such that the length of the printer is increased in the width direction thereof as the right sidewall is closer to the lower side in the height direction of the printer. However, unlike the housing middle 110, in the housing middle 300, the left sidewall 319 is not curved in the depth direction of the printer.

The attachment hole 202 having the same shape as the attachment hole 116 provided in the right sidewall 301 is provided in the left sidewall 319 having such a shape. The inner sheet metal 161 is press-fitted into the attachment hole 202. Note that the attachment holes 202 are formed at total four positions with two positions on the upper side and two positions on the lower side. In addition, the substantially circular screw inserting hole 203 is similarly provided.

The two attachment holes 202 provided on the upper side are provided to have an orientation different from that of the attachment holes 202 provided on the upper side. Therefore, the pieces of inner sheet metal 161, which are press-fitted into the attachment holes 202 on the upper side, of the pieces of inner sheet metal 161 attached to the left sidewall 319, have the elongated hole 166 extending in an orientation different from that in the other pieces of inner sheet metal 161 which are press-fitted into the attachment holes 202 on the lower side. More specifically, the elongated hole 166 of the inner sheet metal 161, which is press-fitted into the attachment hole 202 on the upper side, extends in the rightward-leftward direction (depth direction of the housing 101) in FIG. 33, and the elongated hole 166 of the inner sheet metal 161, which is press-fitted into the attachment hole 202 on the lower side, extends in the vertical direction (height direction of the housing 101) in FIG. 33.

Figure 34:
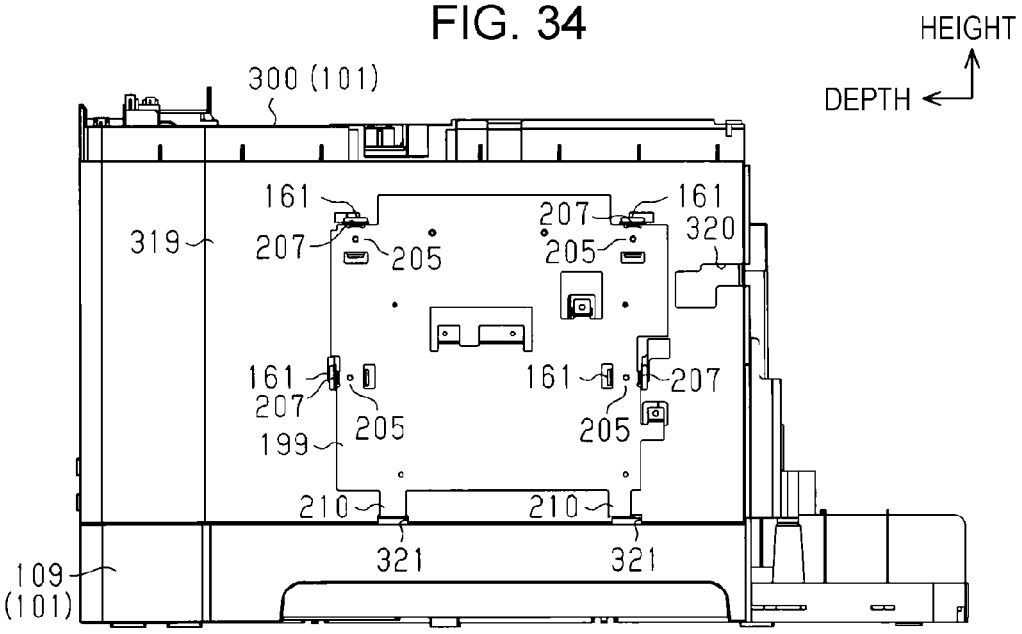
FIG. 34 is a left side view of the housing middle showing a state in which the inner sheet metal and the outer sheet metal are fastened to each other in the recording apparatus of the second embodiment.

As shown in FIG. 34, the outer sheet metal 199 having the same configuration as in the first embodiment is fastened to the inner sheet metal 161 press-fitted into the left sidewall 319 of the housing middle 300.

As shown in FIG. 34, with the lower end of the housing middle 300 supported by the base frame 109, the two insertion portions 210 provided on the lower end of the outer sheet metal 199 are inserted into the cutout portions 321, respectively, provided on the lower end of the left sidewall 319 of the housing middle 300. In this manner, the lower end of the outer sheet metal 199 is supported by the housing 101 from below. In addition, the projecting portions 207 provided in the fastening portions 205 of the outer sheet metal 199, respectively, are inserted into the elongated holes 166 of the pieces of inner sheet metal 161. Since the inner hole portion 121 provided in the attachment hole 202 of the left sidewall 319 is overlapped with the elongated hole 166 of the inner sheet metal 161, the projecting portion 207 inserted into the elongated hole 166 is also inserted into the inner hole portion 121 and penetrates through the left sidewall 319 of the housing middle 300.

In addition, in the state in which the inner sheet metal 161 and the outer sheet metal 199 are fastened to each other, the outer sheet metal 199 does not reach the recessed portion 320 of the left sidewall 319. Therefore, the recessed portion 320 is not covered with the outer sheet metal 199, and the outer sheet metal 199 is not an obstacle when the ink supply tube 196 or the individual cable is guided into the inside of the housing 101.

Figure 35:
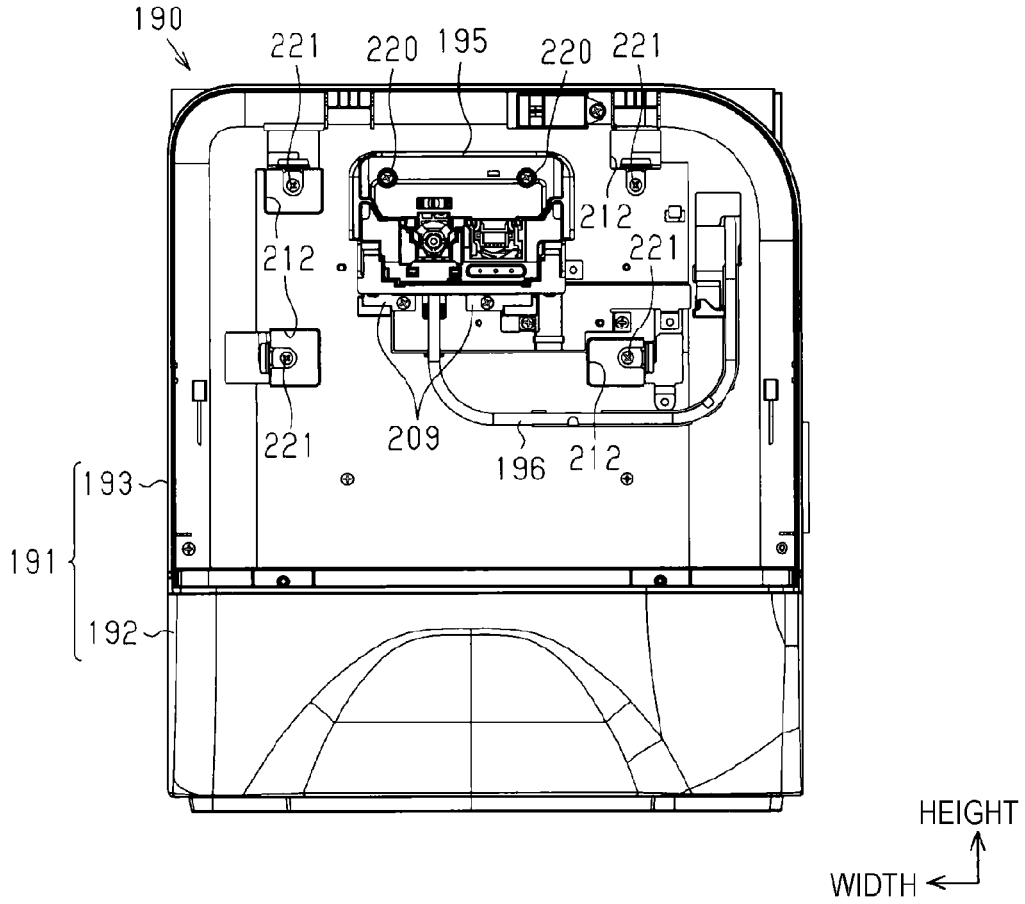
FIG. 35 is a front view of a second liquid containing unit of the recording apparatus of the second embodiment, with a lid and a cover removed.

As shown in FIG. 35, the case 191 of the second liquid containing unit 190 is fastened to the outer sheet metal 199 with a plurality of screws inserted from the inner side of the case 191. In addition, the stay 195 is fixed to the inner surface of the case 191. The screw 220, with which the upper end of the stay 195 is fixed to the case 191, penetrates through the case 191 and is screwed into the boss 208 provided in the outer sheet metal 199. Therefore, the screw 220, with which the upper end portion of the stay 195 is fixed to the case 191, not only fixes the case 191 and the stay 195 to each other, but also the case 191 and the outer sheet metal 199 to each other.

In addition, a hole is provided in a portion of the case 191 facing the lower end portion of the stay 195, and thus the screwing portion 209 of the outer sheet metal 199 is exposed through the portion. The lower end portion of the stay 195 is fastened to the screwing portion 209 with a screw.

The cutout hole 212 is formed in a portion of the side-wall forming member 193 of the case 191 which is not overlapped with the stay 195. The outer sheet metal 199 and the inner sheet metal 161 are disposed such that the screw holes 206 and 162 formed therein, respectively, are overlapped with the cutout hole 212, and the outer sheet metal 199 and the inner sheet metal 161 are fastened to each other with the screw 221 inserted into the screw holes 206 and 162 from the outer sheet metal 199 side. Therefore, the head of the screw 221, with which the case 191 and the housing 101 are fastened to each other, enters a state of being exposed though the cutout hole 212 provided in the case 191.

According to the second embodiment described above, it is possible to achieve the same operational effects of above (1), (2), and (4) to (8).

Other Embodiments

Note that the embodiments described above may be modified as follows.

In the first embodiment described above, the gap is provided between the scanner portion 108 of the housing 101 and the outer sheet metal 160; however, the gap may not be provided with the outer sheet metal 160 abutting on the wall surface of the scanner portion 108. Even in this configuration, it is possible to achieve the effects of above (1) to (8).

In the embodiments described above, the number of the insertion portions 178 and 316 provided on the lower end of the pieces of outer sheet metal 160 and 304 of the first liquid containing unit 140 may be appropriately changed. In addition, the number of the insertion portions 210 provided on the lower end of the outer sheet metal 199 of the second liquid containing unit 190 may be appropriately changed.

In the embodiments described above, the insertion portions 210 are provided on the lower end of the outer sheet metal 199 of the second liquid containing unit 190 such that the insertion portions 210 are inserted to the housing 101 from above; however, the insertion portions 210 is not necessarily provided. Even when the insertion portions 210 are not provided, it is possible to achieve the effects of above (1) to (7).

In the embodiments described above, the cutout hole 212 is formed in the portion which is not overlapped with the stay 195 attached to the inner surface of the case 191 of the second liquid containing unit 190, and the inner sheet metal 161 and the outer sheet metal 199 are disposed such that the screw holes 162 and 206 formed in the inner sheet metal and the outer sheet metal, respectively, are overlapped with the cutout hole 212. Instead of this configuration, the inner sheet metal 161 and the outer sheet metal 199 may be disposed at a position at which the cutout hole 212 and the screw holes 162 and 206 are not overlapped with each other. In addition, the cutout hole 212 may be omitted. Even in this configuration, it is possible to achieve the effects of above (1) to (6).

In the embodiments described above, the insertion portions 178 and 316 are provided on the lower end of the outer sheet metal 160 and 304 of the first liquid containing unit 140 and the insertion portions 178 and 316 are inserted into the housing 101 from above; however, the insertion portions 178 and 316 are not necessarily provided. Even when the insertion portions 178 and 316 are not provided, it is possible to achieve the effects of above (1) to (5).

In the first embodiment described above, the cutout hole 129 is formed in the portion which is not overlapped with the stays 153 attached to the inner surface of the case 141 of the first liquid containing unit 140, and the inner sheet metal 161 and the outer sheet metal 160 are disposed such that the screw holes 162 and 172 formed in the inner sheet metal and the outer sheet metal, respectively, are overlapped with the cutout hole 129. Instead of this configuration, the inner sheet metal 161 and the outer sheet metal 160 may be disposed at a position at which the cutout hole 129 and the screw holes 162 and 172 are not overlapped with each other. In addition, the cutout hole 129 may be omitted. Even in this configuration, it is possible to achieve the effects of above (1) to (4).

In the second embodiment described above, the cutout hole 129 is formed in the portion which is not overlapped with the stays 153 attached to the inner surface of the case 141 of the first liquid containing unit 140, and the inner sheet metal 161 and the outer sheet metal 304 are disposed such that the screw holes 162 and 310 formed in the inner sheet metal and the outer sheet metal, respectively, are overlapped with the cutout hole 129. Instead of this configuration, the inner sheet metal 161 and the outer sheet metal 304 may be disposed at a position at which the cutout hole 129 and the screw holes 162 and 310 are not overlapped with each other. In addition, the cutout hole 129 may be omitted. Even in this configuration, it is possible to achieve the effects of above (1), (2), and (4).

In the embodiments described above, the configuration, in which the right sidewalls 111 and 301 of the housing middles 110 and 300 are provided with four attachment holes 116 into which the pieces of inner sheet metal 161 are press-fitted, is described as an example; however, it is possible to appropriately change the number of the attachment holes 116. Note that, in a case where two or more attachment holes 116 are provided, it is desirable that at least one of the attachment holes is positioned to have the elongated hole 166 extending in an orientation different from that in the other pieces of inner sheet metal 161.

In the embodiments described above, the configuration, in which the left sidewall 112 and 319 of the housing middle 110 and 300 are provided with four attachment holes 202 into which the pieces of inner sheet metal 161 are press-fitted, is described as an example; however, it is possible to appropriately change the number of the attachment holes 202. Note that, in a case where two or more attachment holes 202 are provided, it is desirable that at least one of the attachment holes is positioned to have the elongated hole 166 extending in an orientation different from that in the other pieces of inner sheet metal 161.

In the second embodiment described above, the pieces of inner sheet metal 161 press-fitted into the attachment holes 116 and 202 on the upper side of the side surface of the housing 101 is attached to have the elongated hole 166 extending in a direction different from that in the pieces of inner sheet metal 161 press-fitted into the attachment holes 116 and 202 on the lower side. By comparison, the inner sheet metal 161 press-fitted into the attachment hole 116 or 202 on the upper side may be attached to have the elongated hole 166 extending in the same direction as that in the pieces of inner sheet metal 161 press-fitted into the attachment hole 116 and 202 on the lower side. Even in this configuration, it is possible to achieve the effects of above (1) and (2).

In the first embodiment described above, the inner sheet metal 161 press-fitted into the attachment hole 202 on the upper side of the left-side surface of the housing 101 is attached to have the elongated hole 166 extending in a direction different from that in the inner sheet metal 161 press-fitted into the attachment hole 202 on the lower side. In contrast, the inner sheet metal 161 press-fitted into the attachment hole 202 on the upper side may be attached to have the elongated hole 166 extending in the same direction as that in the inner sheet metal 161 press-fitted into the attachment hole 202 on the lower side. Even in this configuration, it is possible to achieve the effects of above (1) to (3).

In the first embodiment described above, the inner sheet metal 161 is attached to the housing 101 such that the direction, in which the elongated hole 166 of the inner sheet metal 161 press-fitted into the attachment hole 116 on the upper side of the right-side surface of the housing 101 extends, is different from the direction, in which the longitudinal hole 126 provided between the attachment holes 116 on the lower side extends. In contrast, the inner sheet metal 161 is attached to the housing such that the direction, in which the elongated hole 166 of the inner sheet metal 161 press-fitted into the attachment hole 116 on the upper side extends, is the same as the direction, in which the longitudinal hole 126 extends. Even in this configuration, it is possible to achieve the effects of above (1) and (2).

In the embodiments described above, the pieces of inner sheet metal 161 are press-fitted into the attachment hole 116 and 202 provided on the wall surface of the housing 101 made of a resin; however, the inner sheet metal may be fixed in a method other than the press fitting. For example, the inner sheet metal 161 may be fixed by a method in which the inner sheet metal adheres to the outer surface of the housing 101, or the like. Even in this configuration, it is possible to achieve the effect of above (1).

In the embodiments described above, the inner sheet metal 161 and the outer sheet metal are fastened to each other with the screw penetrating through the metal from the outer sheet metal side; however, the inner sheet metal 161 and the outer sheet metal may be fastened to each other with the screw penetrating through the metal from the inner sheet metal 161 side.

In the embodiments described above, the inner sheet metal 161 is attached to the inner surface of the housing 101 and the outer sheet metal is attached to the outer surface of the case 141; however, the inner sheet metal 161 may be attached to the outer surface of the housing 101 and the outer sheet metal may be attached to the inner surface of the case 141.

In the embodiments described above, the configuration, in which the liquid containing units 140 and 190 are mounted on both the side surfaces of the housing 101, is described; however, only one of the liquid containing unit 140 or 190 may be provided.

In the embodiments described above, the recording apparatus, in which the direction in which the signage appears on the operating panel 104 is the same as the direction in which the discharge port 105 is provided, is described as an example; however, the directions may be different from each other.

In the embodiments described above, the direction in which the signage appears on the operating panel 104 is referred to as the front of the printer and the housing 101; however, the side on which the operating panel 104 is provided may be the front of the printer and the housing 101.

In the embodiments described above, the example, in which the power cord 214 is connected to the plug port 215 of the housing 101, is described; however, a USB cable, a LAN cable, a memory card, or the like, may be connected to the plug port 215.

In the embodiments described above, the sponge 219 is attached to the upper end of the outer sheet metal 160 that is attached to the first liquid containing unit 140 such that the gap between the housing 101 and the case 141 is blocked; however, for example, the sponge 219 may be attached to a front end of the outer sheet metal 160, or the sponge 219 may be attached to another position of the outer sheet metal 160.

In the embodiments described above, the sponge 219 is attached to the upper end of the outer sheet metal 160 such that the gap between the housing 101 and the case 141 is blocked; however, the sponge 219 may be attached to the outer sheet metal 199 that is attached to the second liquid containing unit 190. In this configuration, it is possible to further block the gap between the housing 101 and the case 191.

In the embodiments described above, the example, in which the sponge as a sealing member is interposed between first liquid containing unit 140 and the housing 101, is described; however, another member such as rubber may be interposed therebetween as the sealing member. In addition, such a sealing member may not be necessarily provided.

In the second embodiment described above, the first liquid containing unit 140 is mounted to the right-side surface of the housing 101 without being inclined with respect to the depth direction of the printer; however, the first liquid containing unit 140 may be mounted by being inclined with respect to the depth direction of the printer. In other words, the first liquid containing unit 140 may be mounted to the housing 101 in a state of being inclined with respect to the depth direction of the printer such that the outer surface of the case 141 of the first liquid containing unit 140, which faces the housing 101, is positioned further on the inner side in the width direction of the printer as the outer surface is closer to the front side in the depth direction of the printer. Note that, in this configuration, it is possible to obtain a degree of projecting of the fastening portions 307 and 308 of the outer sheet metal 304, with respect to the outer sheet metal 304, by changing the position in the depth direction of the printer.

In the embodiments described above, the second liquid containing unit 190 is mounted to the left-side surface of the housing 101 without being inclined with respect to the depth direction of the printer; however, the second liquid containing unit 190 may be mounted by being inclined with respect to the depth direction of the printer. In other words, the second liquid containing unit 190 may be mounted to the housing 101 in a state of being inclined with respect to the depth direction of the printer such that the outer surface of the case 191 of the second liquid containing unit 190, which faces the housing 101, is positioned further on the inner side in the width direction of the printer as the outer surface is closer to the front side in the depth direction of the printer.

In the first embodiment described above, both the side surfaces of the housing 101 are formed to have a slightly curved shape in the depth direction of the printer such that the length of the printer is shortened in the width direction thereof as the side surface is closer to the front side and is closer to the rear side deep in the printer, that is, such that the central portion projects outward in the width direction of the printer. Instead of this configuration, at least one of both the side surfaces of the housing 101 may be formed without being curved.

In the embodiments described above, the case 191 of the second liquid containing unit 190 is mounted to the housing 101 in a state of being inclined with respect to the height direction of the printer so as to be matched with the left sidewalls 112 and 319. Instead of this configuration, the case 191 may be mounted to the housing 101 without being inclined with respect to the height direction of the printer.

In the embodiments described above, the case 141 of the first liquid containing unit 140 is mounted to the housing 101 in a state of being inclined with respect to the height direction of the printer so as to be matched with the right sidewalls 111 and 301. Instead of this configuration, the case 141 may be mounted to the housing 101 without being inclined with respect to the height direction of the printer.

In the embodiments described above, the example, in which both the side surfaces of the housing 101 are formed to have a slightly inclined shape with respect to the height direction of the printer, is described; however, one side surface of the housing 101 may not be inclined with respect to the height direction of the printer. In addition, both the side surfaces of the housing 101 may not be inclined with respect to the height direction of the printer.

In the embodiments described above, both the first liquid containing unit 140 and the second liquid containing unit 190 are positioned on the rear side deeper from a portion of the housing 101 on the frontmost side in the depth direction of the printer; however, only one may be positioned on the rear side. In addition, both the first liquid containing unit 140 and the second liquid containing unit 190 may project to the front side from the portion of the housing 101 on the frontmost side in the depth direction of the printer.

Figure 36:
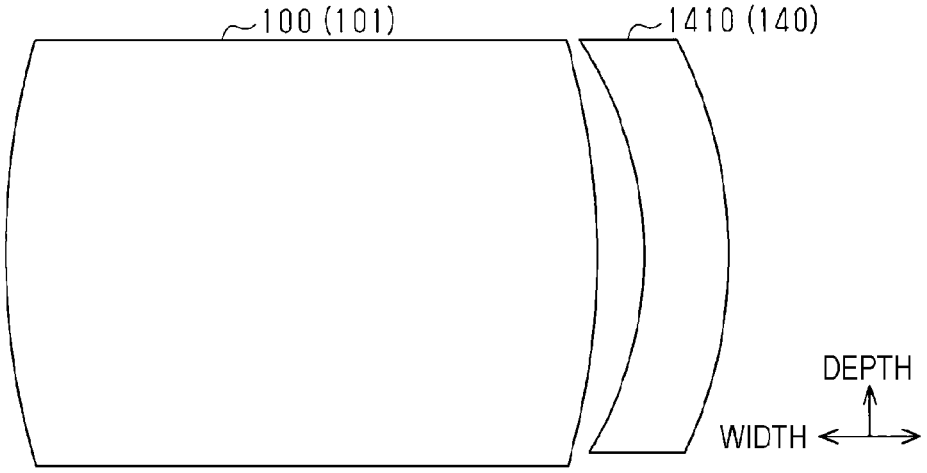
FIG. 36 is a view schematically showing another recording apparatus when the recording apparatus as another example is viewed from above.

In the embodiments described above, the example, in which the substantially rectangular parallelepiped cases 141 and 191 are provided, is described; however, a curved case 1410 may be provided as shown in FIG. 36. Note that, in this case, as shown in FIG. 36, the case 1410 may be further curved than the curved side surface of the housing 101.

In the embodiments described above, the second liquid containing unit 190 is mounted on the left-side surface of the housing 101 such that the second liquid containing unit 190 is not positioned on the rear side further than the plug port 215 in the depth direction of the printer; however, the second liquid containing unit 190 may be mounted so as to be positioned on the rear side further than the plug port 215.

In the embodiments described above, the plug port 215 is provided on the end portion of the rear surface of the printer on the left-side surface side; however, the installation position of the plug port 215 is not limited thereto, and, for example, the plug port may be provided on the end portion of the rear surface of the printer on the right-side surface side. In the case where the plug port 215 is provided on the end portion of the rear surface of the printer on the right-side surface side, it is desirable that the first liquid containing unit 140 is mounted to the housing 101 so as not to be positioned further on the rear side than the plug port 215 in the depth direction of the printer.

In the embodiments described above, the example, in which the width of the printer is increased as the width is measured at a position deeper in the depth direction of the printer, is described; however, this configuration is not necessarily employed.

In the embodiments described above, the recording apparatus may be a liquid ejecting apparatus that ejects or discharges a liquid other than ink and performs recording. For example, the recording apparatus may be a liquid ejecting apparatus that performs recording by ejecting a liquid material containing, by a method of dispersion or dissolving, a material such as an electrode material or a color material (pixel material) that is used in manufacturing of a liquid crystal display, an electroluminescence (EL) display, and a field emission display. In addition, the recording apparatus may be a fluid ejecting apparatus that ejects fluid such as gel (for example, physical gel).

The invention is not limited to the structure in which the outer sheet metal 160 attached to the case 141 and the inner sheet metal 161 attached to the housing 101 are fastened to each other with the screw 131, and sheet metal may be provided to the wall surface, which is made of a resin, of one of the housing 101 or the case 141, and the case 141 and the housing 101 may be fastened to each other via the sheet metal such that the case 141 is mounted to the housing 101.

REFERENCE SIGNS LIST

100 RECORDING UNIT
101 HOUSING
102 LIQUID EJECTING HEAD (RECORDING PORTION)
103 CARRIAGE
104 OPERATING PANEL
105 DISCHARGE PORT
106 DISCHARGE TRAY
107 FEED CASSETTE
108 SCANNER PORTION
109 BASE FRAME
110 HOUSING MIDDLE
111 RIGHT WALL
112 LEFT WALL
113 CEILING PORTION
114 RECESSED PORTION
115A, 115B CUTOUT PORTION
116 ATTACHMENT HOLE
116A ATTACHMENT HOLE
117 FIRST ATTACHMENT HOLE
118 SECOND ATTACHMENT HOLE
119 UPPER HOLE PORTION
120 LOWER HOLE PORTION
121 INNER HOLE PORTION
122 ATTACHMENT HOLE PORTION
123 OUTER HOLE PORTION
124 STEP
125 CREW INSERTING HOLE
126 LONGITUDINAL HOLE
127 SUPPORT HOLE
128 SCREW
129 CUTOUT HOLE
130 INTERFERENCE PREVENTATIVE HOLE
131 SCREW
140 FIRST LIQUID CONTAINING UNIT
141 CASE
142 BOTTOM FORMING MEMBER
143 SIDE-WALL FORMING MEMBER
144 LID
150 LIQUID CONTAINER
150A FIRST LIQUID CONTAINER
150B SECOND LIQUID CONTAINER
150C THIRD LIQUID CONTAINER
151 INK BAG
152 HANDLE
153 STAY
154 INK SUPPLY TUBE
155 CLAMP
156 TUBE INSERTING HOLE
157 INDIVIDUAL CABLE
158 RELAY SUBSTRATE
159 INTEGRATED CABLE
160 OUTER SHEET METAL (SECOND SHEET METAL MEMBER)
161 INNER SHEET METAL (FIRST SHEET METAL MEMBER)
162 SCREW HOLE
163 TOP PLATE PORTION
163A NARROWED WIDTH PORTION
163B WIDENED WIDTH PORTION
164 FIRST HOLDER
165 SECOND HOLDER
166 ELONGATED HOLE
167 UPPER SHEET METAL
168 LOWER SHEET METAL
169 FASTENING PORTION
169A FIRST FASTENING PORTION
169B SECOND FASTENING PORTION
170 FASTENING PORTION
170A THIRD FASTENING PORTION
170B FOURTH FASTENING PORTION
171 REFERENCE SURFACE
172 SCREW HOLE
173 REFERENCE SURFACE
174, 175 PROJECTING PORTION
176 BOSS
177 SCREWING PORTION
178 INSERTION PORTION
179 NOTCH
180 HOLE PORTION
190 SECOND LIQUID CONTAINING UNIT
191 CASE
192 BOTTOM FORMING MEMBER
193 SIDE-WALL FORMING MEMBER
194 LID
195 STAY
196 INK SUPPLY TUBE
197 CLAMP
198 TUBE INSERTING HOLE
199 OUTER SHEET METAL (SECOND SHEET METAL MEMBER)
200 RECESSED PORTION
201A, 201B CUTOUT PORTION
202 ATTACHMENT HOLE
203 SCREW INSERTING HOLE
204 COVER MEMBER
205 FASTENING PORTION
206 SCREW HOLE
207 PROJECTING PORTION
208 BOSS
209 SCREWING PORTION
210 INSERTION PORTION
211 HOLE PORTION

212 CUTOUT HOLE
213 INTERFERENCE PREVENTATIVE HOLE
214 POWER CORD
215 INSERTION PORT
216 MOUNTING TRAY
217 SHEET DELIVERY PORTION
218 DECORATIVE SHEET
219 SPONGE
220 SCREW
221 SCREW
300 HOUSING MIDDLE
301 RIGHT WALL
302 RECESSED PORTION
303 CUTOUT PORTION
304 OUTER SHEET METAL (SECOND SHEET METAL MEMBER)
305 UPPER SHEET METAL
306 LOWER SHEET METAL
307 LOWER-SIDE FASTENING PORTION
308 UPPER-SIDE FASTENING PORTION
309 REFERENCE SURFACE
310 SCREW HOLE
311 PROJECTING PORTION
312 REFERENCE SURFACE
313 PROJECTING PORTION
314 BOSS
315 SCREWING PORTION
316 INSERTION PORTION
317 NOTCH
318 HOLE PORTION
319 LEFT WALL
320 RECESSED PORTION
321 CUTOUT PORTION
322 SCREW
1410 CASE

The entire disclosure of Japanese Patent Application No. 2014-052604, filed Mar. 14, 2014 is expressly incorporated by reference herein.

The invention claimed is:

1. A recording apparatus comprising:

a recording portion that ejects a liquid and performs recording on a recording medium;

a housing in which the recording portion is accommodated;

a liquid container in which a liquid that is supplied to the recording portion is contained; and a case in which the liquid container is accommodated, wherein a first metal member is attached to a wall surface of the housing, which is formed of a resin, and a second metal member is attached to a wall surface of the case, which is formed of a resin, wherein the first metal member and the second metal member are fastened to each other, and thereby the case is mounted in the housing, with at least one of the housing or the case interposed between the first metal member and the second metal member, wherein an elongated hole is formed in the first metal member so as to have a length in a longitudinal direction that is different from a length in a transverse direction, and a plurality of projecting portions are formed on the second metal member so as to have a shape corresponding to the elongated hole and to be inserted into the elongated hole, wherein at least one of a plurality of the first metal members attached to the housing is attached to have an orientation different from the other first metal members such that an orientation, in which the elongated hole extends, is different from that in the other first metal members, and wherein the plurality of projecting portions provided in the second metal member are inserted into the elongated holes in the plurality of first metal members attached to the housing, respectively.

2. The recording apparatus according to claim 1, wherein the first metal member is attached to an inner surface of the housing and the second metal member is attached to an outer surface of the case.

3. The recording apparatus according to claim 2, wherein the first metal member is press-fitted into an attachment hole provided in the wall surface of the housing, which is formed of a resin.

4. The recording apparatus according to claim 1, wherein a liquid container holder, on which the liquid container is demountably mounted, is attached to the inner surface of the case, wherein a cutout hole is formed in a portion of the case, which is not overlapped with the liquid container holder, wherein the second metal member is attached to the outer surface of the case, and wherein the first metal member and the second metal member are disposed such that respective screw holes formed in the first metal member and second metal member are overlapped with the cutout hole, and the first metal member and the second metal member are fastened to each other, with a screw inserted into the screw holes from the second metal member side.

5. The recording apparatus according to claim 1, wherein the second metal member is attached to the outer surface of the case and at least a part of a lower end of the second metal member is inserted into the housing from above such that the second metal member is supported by the housing from below.

6. The recording apparatus according to claim 1, wherein a scanner portion, in which a scanner is accommodated, is provided in the housing, and wherein the second metal member attached to the outer surface of the case faces the scanner portion, and a gap is provided therebetween.

* * * * *